US010946654B2

(12) United States Patent
Matsubara

(10) Patent No.: US 10,946,654 B2
(45) Date of Patent: Mar. 16, 2021

(54) LIQUID EJECTING HEAD, LIQUID EJECTING APPARATUS, AND METHOD FOR SETTING BIAS POTENTIAL IN LIQUID EJECTING HEAD

(71) Applicant: SEIKO EPSON CORPORATION, Tokyo (JP)

(72) Inventor: Yoshitaka Matsubara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/542,525

(22) Filed: Aug. 16, 2019

(65) Prior Publication Data

US 2020/0055315 A1 Feb. 20, 2020

(30) Foreign Application Priority Data

Aug. 18, 2018 (JP) ..... JP2018-153758

(51) Int. Cl.
*B41J 2/14* (2006.01)
*B41J 2/16* (2006.01)
*B41J 2/045* (2006.01)

(52) U.S. Cl.
CPC ..... *B41J 2/14233* (2013.01); *B41J 2/04581* (2013.01); *B41J 2/14209* (2013.01); *B41J 2/161* (2013.01); *B41J 2002/14491* (2013.01)

(58) Field of Classification Search
CPC ..... B41J 2/04581; B41J 2/045; B41J 2/055; B41J 2/14233; B41J 2/161; B41J 2/14209
USPC ..... 347/68, 70–72
See application file for complete search history.

(56) References Cited

U.S. PATENT DOCUMENTS 9,272,507 B2 * 3/2016 Miyazawa ..... B41J 2/14233
9,937,716 B2 * 4/2018 Mikoshiba ..... B41J 2/161
10,668,724 B2 * 6/2020 Takabe ..... B41J 2/1642

FOREIGN PATENT DOCUMENTS

JP H11-221921 8/1999
JP 2015-054426 3/2015

* cited by examiner

*Primary Examiner* — An H Do
(74) *Attorney, Agent, or Firm* — Workman Nydegger

(57) ABSTRACT

A liquid ejecting head includes a nozzle array composed of nozzles, pressure generating chambers communicating with the nozzles of the nozzle array, and actuators that are positioned to correspond individually to the pressure generating chambers. Each the actuators includes a piezoelectric layer being sandwiched by a first electrode and a second electrode. The first electrode serves as individual electrodes provided individually for the respective actuators. The second electrode serves as a first common electrode that extends over the actuators corresponding to a first region of the nozzle array and a second common electrode that extends over the actuators corresponding to a second region of the nozzle array.

12 Claims, 13 Drawing Sheets

LIQUID EJECTING HEAD, LIQUID EJECTING APPARATUS, AND METHOD FOR SETTING BIAS POTENTIAL IN LIQUID EJECTING HEAD

The present application is based on, and claims priority from JP Application Serial Number 2018-153758, filed Aug. 18, 2018, the disclosure of which is hereby incorporated by reference herein in its entirety.

BACKGROUND

1. Technical Field

The present disclosure relates to a liquid ejecting head including a piezoelectric actuator that causes changes in pressure in a flow channel communicating with a nozzle configured to discharge liquid, a liquid ejecting apparatus including such a liquid ejecting head, and a method for setting bias potential to be applied to the piezoelectric actuator of such a liquid ejecting head. In particular, the present disclosure relates to an ink jet recording head that discharges ink as the liquid, an ink jet recording apparatus, and a method for setting bias potential in such an ink jet recording head.

2. Related Art

A piezoelectric actuator used in a liquid ejecting head is formed by interposing between two electrodes a piezoelectric layer made of a piezoelectric material having an electromechanical conversion functionality, such as a crystal dielectric material. One representative example of the liquid ejecting head is an ink jet recording head in which a vibrating plate constitutes part of a pressure generating chamber communicating with an opening of a nozzle from which ink droplets are discharged. In the ink jet recording head, ink in the pressure generating chamber is pressurized by changing the shape of the vibrating plate by using a piezoelectric actuator, and as a result, ink droplets are discharged from the nozzle.

In such an ink jet recording head, the amount of discharged ink droplets may vary in a nozzle array formed by arranging nozzles due to, for example, variations of the structure of a flow channel or variations in the degree of a displacement characteristic depending on the electrical resistance of the piezoelectric actuator. This may worsen print quality.

In this regard, an ink jet recording head is introduced in which variations in the amount of ink droplets is decreased by supplying to a particular nozzle array a drive signal that is selected as appropriate, in accordance with the degrees of ink-droplet discharge characteristics of the particular nozzle array, from multiple drive signals at different voltage levels prepared as drive signals for driving a piezoelectric actuator (see, for example, JP-A-11-221921).

However, preparing multiple drive signals as in JP-A-11-221921 has a problem in which the configuration becomes complex and the cost increases because it is necessary to involve multiple sets of a drive signal generating circuit, a switching component, or the like.

The same problem exists in not only the ink jet recording apparatus but also other liquid ejecting apparatuses that eject liquids other than ink.

SUMMARY

In consideration of these conditions, the present disclosure provides a liquid ejecting head, a liquid ejecting apparatus, and a method for setting bias potential in such a liquid ejecting head by which print quality can be improved by reducing variations of the amount of discharged liquid and the cost can be decreased by simplifying the configuration.

To address the problem described above, an aspect of the present disclosure provides a liquid ejecting head including a nozzle array composed of nozzles that are aligned and configured to discharge liquid, a flow channel substrate in which pressure generating chambers communicating with the nozzles of the nozzle array are formed, and a piezoelectric actuator that is positioned on one side of the flow channel substrate and that includes a first electrode, a piezoelectric layer, and a second electrode. The piezoelectric actuator includes active portions that are each a portion of the piezoelectric layer, the portion being sandwiched by the first electrode and the second electrode, and that are positioned to correspond individually to the pressure generating chambers. Any one electrode of the first electrode and the second electrode serves as individual electrodes provided individually for the respective active portions. Another electrode of the first electrode and the second electrode serves as a common electrode provided to be shared by the multiple active portions. The common electrode is divided into at least two regions in the single nozzle array in a direction in which the nozzles are aligned.

Moreover, another aspect of the present disclosure provides a liquid ejecting apparatus including the liquid ejecting head according to the aspect of the present disclosure described above and a controller that supplies a drive signal common to the nozzle array selectively to the individual electrodes of the piezoelectric actuator and that supplies a bias potential to the common electrode.

Furthermore, still another aspect of the present disclosure provides a method for setting bias potential in a liquid ejecting head. The liquid ejecting head includes a nozzle array composed of nozzles that are aligned and configured to discharge liquid, a flow channel substrate in which pressure generating chambers communicating with the nozzles of the nozzle array are formed, and a piezoelectric actuator that is positioned on one side of the flow channel substrate and that includes a first electrode, a piezoelectric layer, and a second electrode. The piezoelectric actuator includes active portions that are each a portion of the piezoelectric layer, the portion being sandwiched by the first electrode and the second electrode, and that are positioned to correspond individually to the pressure generating chambers. Any one electrode of the first electrode and the second electrode serves as individual electrodes provided individually for the respective active portions. Another electrode of the first electrode and the second electrode serves as a common electrode provided to be shared by the multiple active portions. The common electrode is divided into at least two regions in the nozzle array in a direction in which the nozzles are aligned and the divided common electrode includes a first region and a second region. A drive signal common to the nozzle array is supplied selectively to the individual electrodes of the piezoelectric actuator and a bias potential is supplied to the common electrode. The method for setting bias potential in the liquid ejecting head includes measuring the average amount of discharged liquid ejected from a first nozzle group constituted by particular nozzles of the nozzles, the particular nozzles corresponding to particular active portions that are among the active portions and share the first region as a common electrode and the average amount of discharged liquid ejected from a second nozzle group constituted by other particular nozzles of the nozzles, the other particular nozzles corresponding to other particular active portions that are among the active portions and share the second region as a common electrode when the drive signal is applied while a standard bias potential is supplied, and determining, with respect to each of the first region and the second region, a bias potential in accordance with a result of comparing the measured average amount of discharged liquid with a standard amount of discharged liquid.

DESCRIPTION OF EXEMPLARY EMBODIMENTS

Figure 1:
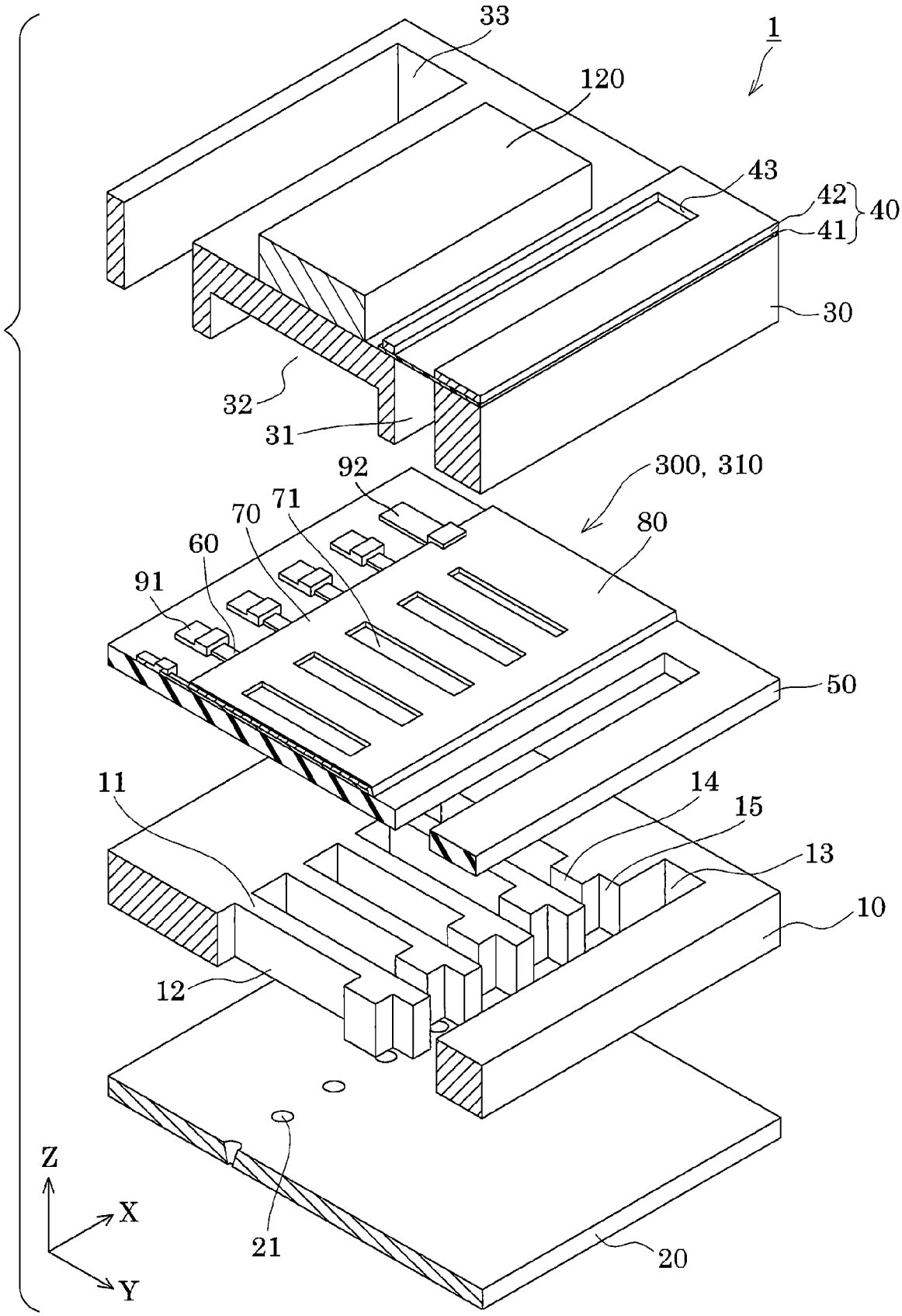
FIG. 1 illustrates a schematic configuration of a recording head.

Hereinafter, the present disclosure is described in detail in accordance with embodiments. It should be noted that the following description represents merely one aspect of the present disclosure and any modification can be applied within the scope of the present disclosure. The components denoted by the same reference characters in the drawings indicate identical components and descriptions thereof is omitted as appropriate. Additionally, in the drawings, X, Y, and Z denote three spatial axes that are perpendicular to each other. In the description of this specification, directions along these axes are referred to as a first direction X, a second direction Y, and a third direction Z. The third direction Z denotes the vertical direction and the lower side in the vertical direction is referred to as a Z1 side and the upper side in the vertical direction as a Z2 side.

First Embodiment

Figure 2:
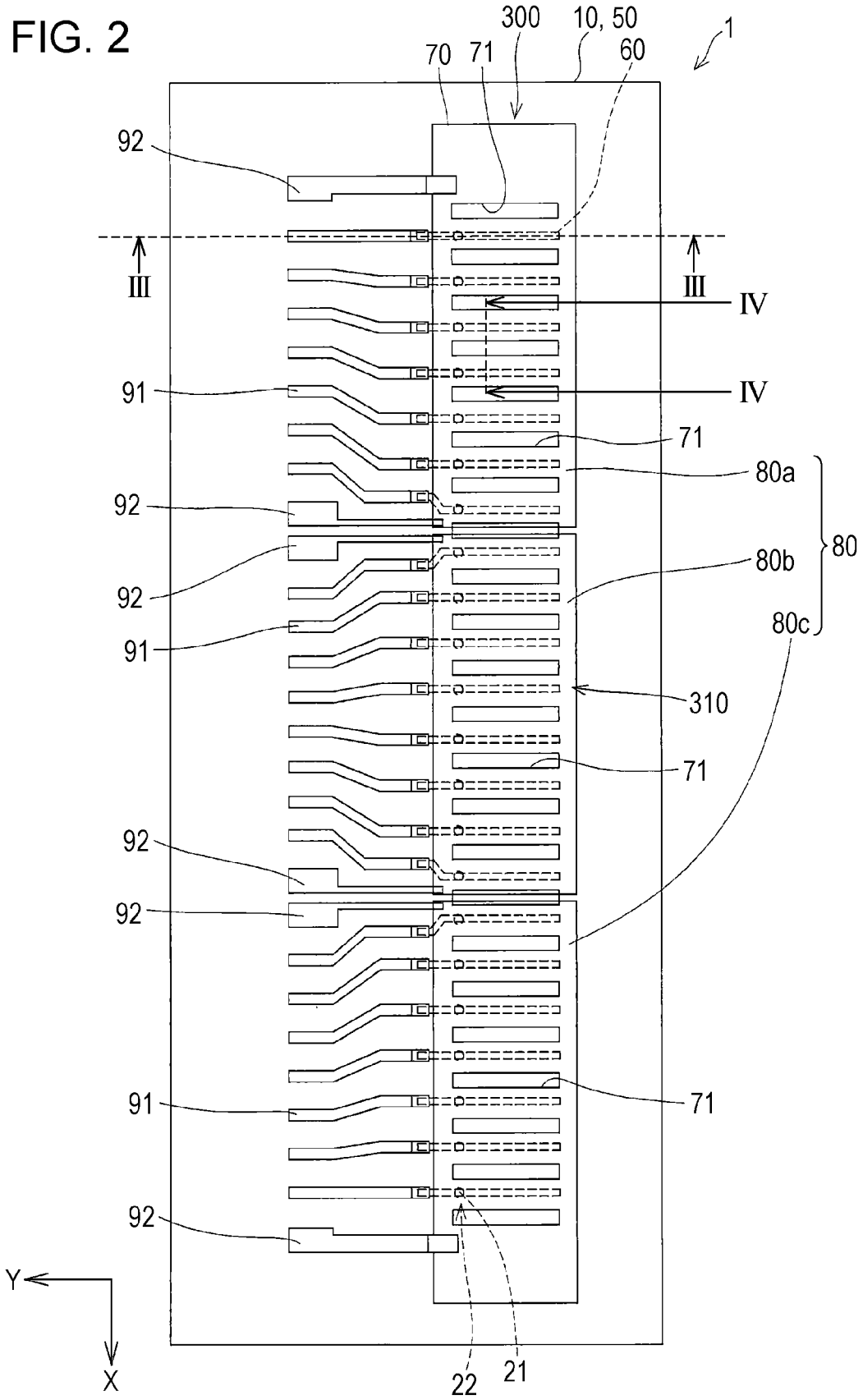
FIG. 2 is a plan view of a flow channel substrate.
Figure 3:
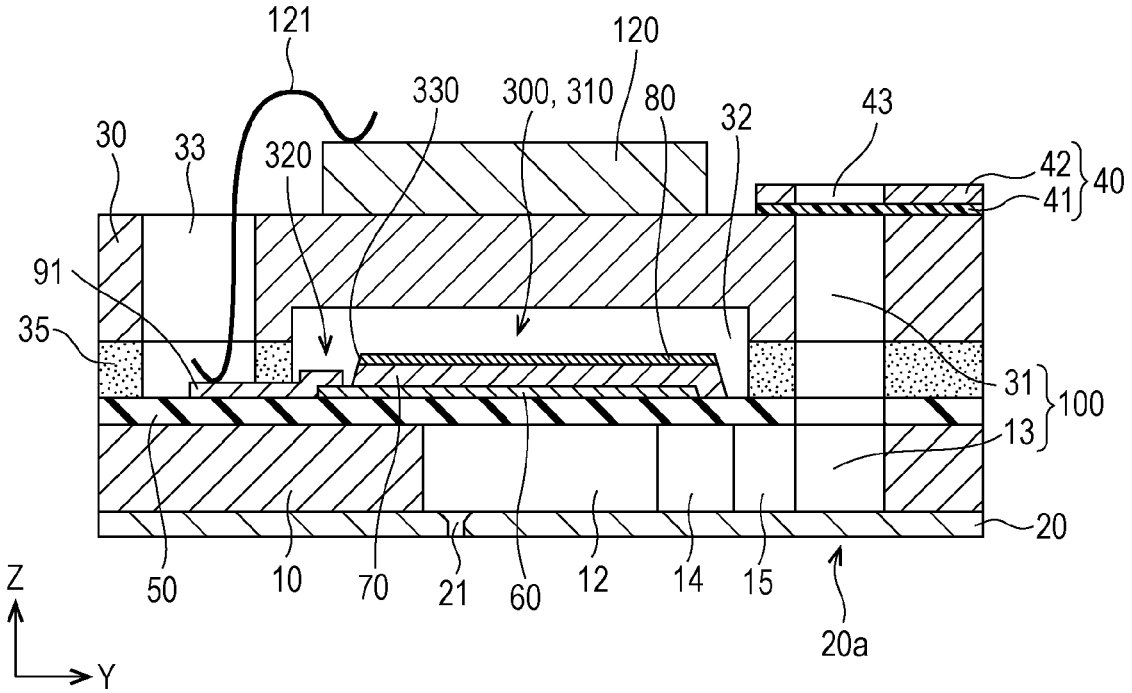
FIG. 3 is a sectional view of the recording head.

FIG. 1 is an exploded perspective view of an ink jet recording head as an example of a liquid ejecting head according to a first embodiment of the present disclosure. FIG. 2 is a plan view of a flow channel substrate. FIG. 3 is a sectional view of the ink jet recording head.

As illustrated in the drawings, a flow channel substrate 10, which is a single crystal silicon substrate, constitutes an ink jet recording head 1 (hereinafter also simply referred to as the recording head 1) as an example of the liquid ejecting head according to this embodiment. A vibrating plate 50 is formed on one surface of the flow channel substrate 10. The vibrating plate 50 may be a single layer or a laminate of multiple layers selected from a silicon dioxide layer and a zirconium oxide layer.

In the flow channel substrate 10, multiple pressure generating chambers 12 are formed side by side in the first direction X by being sectioned by partition walls 11. A communicating section 13 is formed in a region of the flow channel substrate 10 on an outer side with respect to the pressure generating chambers 12 in the first direction X. The communicating section 13 and the pressure generating chambers 12 communicate with each other via ink supply channels 14 and communicating channels 15 that are provided for the respective pressure generating chambers 12. The communicating section 13 constitutes part of a manifold 100 that serves as an ink chamber common to the pressure generating chambers 12 by communicating with a manifold portion 31 of a protective substrate described below. The ink supply channels 14 are each formed to have a width narrower than that of the pressure generating chamber 12 and maintain at a fixed level the flow channel resistance against ink flowing in the pressure generating chamber 12 from the communicating section 13.

On one surface of the flow channel substrate 10 in the third direction Z, a nozzle plate 20 is affixed by using, for example, an adhesive or a thermally fusible film. Nozzles 21 are pierced in the nozzle plate 20 to each communicate with a particular portion close to the end of the corresponding pressure generating chamber 12 opposite to the ink supply channel 14.

In this embodiment, since the pressure generating chambers 12 are arranged in an array extending in the first direction X, a nozzle array 22 is formed by aligning the nozzles 21 in the first direction X to match the array of the pressure generating chambers 12. The multiple pressure generating chambers 12 corresponding to the nozzle array 22 all communicate with the manifold 100 that serves as a common liquid chamber as described below. Thus, in the nozzle array 22 according to this embodiment, the same kind of ink is discharged from all the nozzles 21 constituting the nozzle array 22. Hence, when the nozzles 21 are aligned in the first direction X, in the case in which different kinds of ink are discharged from the nozzles 21, the nozzles 21 are not considered as the nozzle array 22. The nozzle array 22 may be formed in the first direction X by aligning the nozzles 21 communicating individually with sections of the divided manifold 100 that is sectioned in the first direction X.

To produce the nozzle plate 20, for example, a metal such as a steel special use stainless (SUS), an organic substance such as polyimide resin, or a single crystal silicon substrate can be utilized.

On the other surface of the flow channel substrate 10 opposite to the nozzle plate 20 in the third direction Z, the vibrating plate 50 is formed as described above. A piezoelectric actuator 300 is formed on the vibrating plate 50 by stacking a first electrode 60, a piezoelectric layer 70, and a second electrode 80 by employing a deposition method and a lithography method. In this embodiment, the piezoelectric actuator 300 is a drive component that causes changes in pressure on ink in the pressure generating chambers 12. The piezoelectric actuator 300 is also referred to as a piezoelectric component and is a portion involving the first electrode 60, the piezoelectric layer 70, and the second electrode 80. A portion at which piezoelectric strain is induced in the piezoelectric layer 70 when voltage is applied across the first electrode 60 and the second electrode 80 is referred to as an active portion 310. Specifically, the active portion 310 is a portion of the piezoelectric layer 70 and the portion is sandwiched by the first electrode 60 and the second electrode 80 in the third direction Z. In this embodiment, the active portions 310 are formed for the respective pressure generating chambers 12. Typically, one electrode of the piezoelectric actuator 300 is provided as a common electrode and the other electrode and the piezoelectric layer 70 are provided to correspond to each of the pressure generating chambers 12 by patterning. While in this embodiment the first electrode 60 serves as individual electrodes for the respective active portions 310 and the second electrode 80 serves as a common electrode shared by the multiple active portions 310, the same applies in reverse due to the condition of a drive circuit or a wiring. It should be noted that, while in the example described above the vibrating plate 50 and the first electrode 60 collectively function as a vibrating plate, the configuration should not be construed in a limiting sense. For example, only the first electrode 60 may function as a vibrating plate without using the vibrating plate 50. Alternatively, the piezoelectric actuator 300 per se may practically double as a vibrating plate.

Figure 4:
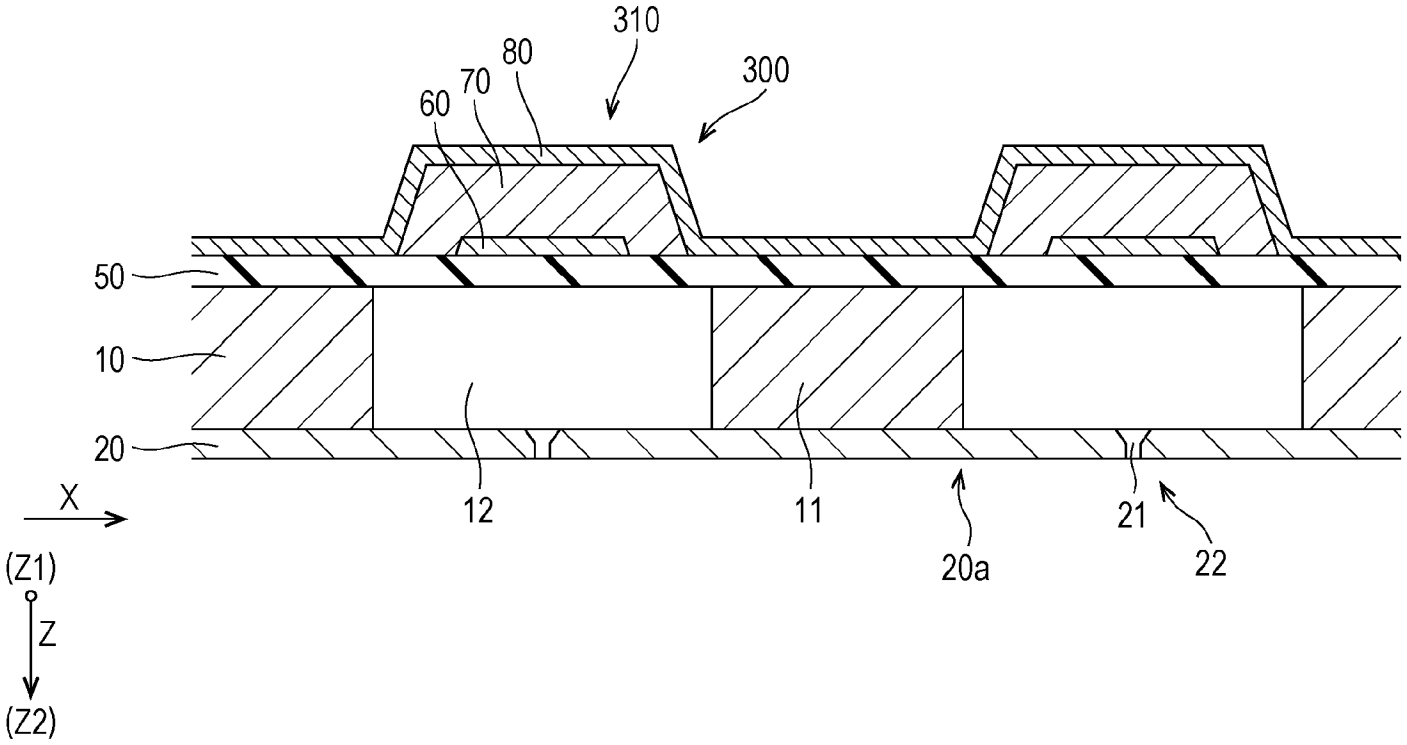
FIG. 4 is another sectional view of the recording head.

The first electrode 60 constituting the piezoelectric actuator 300 according to this embodiment is cut out into multiple portions for the respective pressure generating chambers 12 and the multiple portions of the first electrode 60 serve as individual electrodes separately provided for the respective active portions 310 that are practically driving portions in the piezoelectric actuator 300. As illustrated in FIG. 4, the width of each portion of the first electrode 60 in the first direction X, in which the active portions 310 are aligned, is formed to be narrower than the width of the pressure generating chamber 12; in other words, both ends of each portion of the first electrode 60 in the first direction X of the pressure generating chambers 12 are located inside the region facing the pressure generating chamber 12.

The piezoelectric layer 70 extends continuously in the first direction X while maintaining a fixed width in the second direction Y.

The piezoelectric layer 70 is formed on the first electrode 60 and formed of an oxide piezoelectric material capable of forming a polarized structure, such as a perovskite-type oxide represented by the general formula $ABO_3$, as which, for example, a lead-based piezoelectric material containing lead or a non-lead-based piezoelectric material not containing lead can be used. The piezoelectric layer 70 can be formed by employing, for example, a liquid phase process such as the sol-gel process or the metal-organic decomposition (MOD) method, or a physical vapor deposition (PVD) method, that is, a gas phase process, such as the sputtering method or the laser ablation method.

Recesses 71 corresponding to the partition walls 11 are formed in the piezoelectric layer 70. The width of each of the recesses 71 in the first direction X is substantially identical to or wider than the width of each of the partition walls 11 in the first direction X. This configuration reduces the stiffness of a portion of the vibrating plate 50 opposite to the one ends of the pressure generating chambers 12 in the first direction X, that is, the stiffness of an arm portion of the vibrating plate 50, and as a result, the piezoelectric actuator 300 can be satisfactorily displaced.

The second electrode 80 is positioned on the side of the piezoelectric layer 70 opposite to the first electrode 60 and serves as a common electrode shared by the multiple active portions 310. The second electrode 80 is positioned inside the recesses 71, in other words, on the surfaces of the piezoelectric layer 70 constituting the recesses 71. Needless to say, the second electrode 80 may be positioned on only particular parts of the recesses 71 or positioned not to cover the recesses 71.

The second electrode 80 according to this embodiment, which serves as a common electrode shared by the multiple active portions 310, is divided into at least two and arranged in the first direction X in which the nozzles 21 of the single nozzle array 22 are aligned. Here, the configuration in which the second electrode 80 is divided into at least two and arranged in the first direction X in which the nozzles 21 of the single nozzle array 22 are arrayed denotes the configuration in which the single nozzle array 22 contains at least two nozzle groups each including at least two of the nozzles 21 constituting the single nozzle array 22 and regions of the divided second electrode 80 are each provided to correspond to particular active portions of the multiple active portions 310 associated with particular nozzles of the nozzles 21 constituting each nozzle group; in other words, the second electrode 80 is divided into at least two regions in the first direction X, each region of the divided second electrode 80 is common to particular multiple active portions of the active portions 310, and particular nozzles of the nozzles 21 corresponding to the region of the divided second electrode 80 common to the particular multiple active portions 310 are collectively referred to as a nozzle group.

Specifically, as illustrated in FIG. 2, the second electrode 80 according to this embodiment is divided into three regions: one end region, another end region, and a middle region between the both end regions with respect to the nozzle array 22 in the first direction X. In this embodiment, the three regions of the divided second electrode 80 are referred to, in the order from the one side to the other side in the first direction X, as a first common electrode 80*a*, a second common electrode 80*b*, and a third common electrode 80*c*; in other words, the one end region is referred to as the first common electrode 80*a*, the other end region is referred to as the third common electrode 80*c*, and the middle region between the both end regions, that is, the first common electrode 80*a* and the third common electrode 80*c*, is referred to as the second common electrode 80*b*.

By dividing the second electrode 80 serving as a common electrode into three in the first direction X, regions among which the degrees of ink-droplet discharge characteristics likely vary in the nozzle array 22 can be separated, and as a result, as will be described in detail later, variations of the degrees of ink-droplet discharge characteristics can be easily reduced by individually changing bias potentials supplied to the regions of the divided second electrode 80. Alternatively, the second electrode 80 may be divided into any number of regions, such as two, four, or more.

It should be noted that, because the second electrode 80 serving as a common electrode is divided for the purpose of reducing variations of the degrees of ink-droplet discharge characteristics, the boundary between the first common electrode 80*a* and the second common electrode 80*b* and the boundary between the second common electrode 80*b* and the third common electrode 80*c* are preferably determined as appropriate in accordance with the variations of the degrees of ink-droplet discharge characteristics in the nozzle array 22. Hence, the first common electrode 80*a*, the second common electrode 80*b*, and the third common electrode 80*c* are preferably separated at points at which the degrees of ink-droplet discharge characteristics vary at the maximum in the nozzle array 22. With this configuration, as will be described in detail later, variations of the degrees of ink-droplet discharge characteristics in the nozzle array 22 can be effectively reduced by applying different bias potentials to the first common electrode 80*a*, the second common electrode 80*b*, and the third common electrode 80*c*. Alternatively, the boundary between the first common electrode 80*a* and the second common electrode 80*b* and the boundary between the second common electrode 80*b* and the third common electrode 80*c* may be determined to balance the number of the active portions 310.

As illustrated in FIG. 4, the second electrode 80 serving as a common electrode is formed to cover a region between one of the pressure generating chambers 12 and adjacent another of the pressure generating chambers 12 with respect to each of the pressure generating chambers 12, that is, the partition wall 11. In addition, in this embodiment, the first common electrode 80*a*, the second common electrode 80*b*, and the third common electrode 80*c* are separately provided without continuously extending on the partition walls 11. As a result, the end of a region of the divided second electrode 80 serving as a common electrode is not positioned at a region corresponding to the pressure generating chamber 12. This configuration can suppress the concentration of stress caused by displacement of the active portion 310 at the end of the region of the divided second electrode 80.

It should be noted that a first region described in claims denotes one electrode selected from the first common electrode 80*a*, the second common electrode 80*b*, and the third common electrode 80*c* and a second region described in claims denotes another electrode selected from two electrodes other than the one electrode having been selected as the first region; in other words, one electrode formed by dividing a common electrode into at least two is referred to as the first region and another electrode other than the first region is referred to as the second region.

An individual wiring 91 leads from each individual electrode of the first electrode 60. Common wirings 92 lead from the second electrode 80. In this embodiment, the second electrode 80 is divided into the three regions, that is, the first common electrode 80*a*, the second common electrode 80*b*, and the third common electrode 80*c*; the common wirings 92 lead from each of the first common electrode 80*a*, the second common electrode 80*b*, and the third common electrode 80*c*; and the common wirings 92 are electrically separately provided without electrical communication. At least two of the common wirings 92 are provided for each of the first common electrode 80*a*, the second common electrode 80*b*, and the third common electrode 80*c*. In this embodiment, the at least two of the common wirings 92 are disposed at both ends of each of the first common electrode 80*a*, the second common electrode 80*b*, and the third common electrode 80*c* in the first direction X. This configuration hinders the occurrence of voltage drop in each of the first common electrode 80*a*, the second common electrode 80*b*, and the third common electrode 80*c* in the first direction X. The number of the common wirings 92 is not limited to the example described above, and alternatively, three or more of the common wirings 92 may be provided for each of the first common electrode 80*a*, the second common electrode 80*b*, and the third common electrode 80*c*.

In this embodiment, the common wirings 92 lead from the piezoelectric actuator 300 in the same direction as that of the individual wirings 91, that is, lead to the side opposite to the ink supply channels 14. The direction in which the common wirings 92 lead is not limited to this example, and alternatively, the common wirings 92 may lead to the side opposite to the individual wirings 91.

Via the individual wirings 91, drive signals are supplied to the first electrode 60; and via the common wirings 92, bias potentials are supplied to the second electrode 80. The first common electrode 80*a*, the second common electrode 80*b*, and the third common electrode 80*c*, which all serve as common electrodes are each coupled to the common wirings 92 having input terminals that are individual. Here, the input terminals that are individual denote that the common wirings 92 coupled to different common electrodes formed by division are not in electrical communication with each other.

In addition, a protective substrate 30 is joined to the surface of the flow channel substrate 10 on the piezoelectric actuator 300 side by using an adhesive 35. The protective substrate 30 includes the manifold portion 31 that constitutes at least part of the manifold 100 serving as a common liquid chamber shared by the multiple pressure generating chambers 12. In this embodiment, the manifold portion 31 is formed to penetrate the protective substrate 30 in the third direction Z and extend in the direction of the width of the pressure generating chamber 12. As described above, the manifold 100 serving as a common ink chamber shared by the pressure generating chambers 12 is constituted by the manifold portion 31 and the communicating section 13 of the flow channel substrate 10 communicating with each other. As a result, the multiple pressure generating chambers 12 communicating with the nozzles 21 constituting the nozzle array 22 are in common communication with the manifold 100 serving as a common liquid chamber.

In a region of the protective substrate 30 facing the piezoelectric actuator 300, a piezoelectric actuator holding portion 32 is positioned with space enough to not hinder the movement of the piezoelectric actuator 300. The piezoelectric actuator holding portion 32 needs to have space only enough to not hinder the movement of the piezoelectric actuator 300 and the space may be sealed or non-sealed.

In order to produce the protective substrate 30, it is preferable to use a material with substantially the same coefficient of thermal expansion as that of the flow channel substrate 10, such as glass or ceramic material. In this embodiment, the protective substrate 30 is formed from a single crystal silicon substrate that is the same material as that of the flow channel substrate 10.

In addition, the protective substrate 30 includes a through-hole 33 penetrating the protective substrate 30 in the third direction Z. End portions of the individual wirings 91 and end portions of the common wirings 92 leading from the piezoelectric actuator 300 are positioned to be exposed in the through-hole 33.

On the surface of the protective substrate 30 opposite to the flow channel substrate 10, a drive circuit 120 that drives the piezoelectric actuator 300 is positioned. As the drive circuit 120, for example, a circuit substrate or a semiconductor integrated circuit (IC) can be utilized. In the drive circuit 120, for example, a switching component, such as a transmission gate, is provided for each of the active portions 310 and a drive signal for activating the active portion 310 is generated at a desired time by opening/closing the switching component in accordance with a control signal that is input by a control device 200 described in detail later. The drive circuit 120 and the individual wiring 91 are electrically coupled to each other via a connection wiring 121 formed of conductive wire such as bonding wire. On the surface of the protective substrate 30 on which the drive circuit 120 is mounted, a wiring that is coupled to the common wiring 92 via the connection wiring 121 is provided, which is not illustrated in the drawings. A bias potential is supplied from the control device 200 to the second electrode 80 through the wiring that is on the protective substrate 30 and coupled to the common wirings 92 via the connection wiring 121. Thus, the bias potential is output by the control device 200 and then supplied directly to the second electrode 80 without passing through the drive circuit 120. It should be noted that, on the surface of the protective substrate 30 on which the drive circuit 120 is mounted, in addition to the wiring through which a bias potential is supplied, another wiring is provided for supplying a control signal and a drive signal to the drive circuit 120 from the control device 200 described in detail later. Alternatively, an external wiring leading from the control device 200 may be coupled directly to the drive circuit 120.

Additionally, a compliance substrate 40 composed of a sealing film 41 and a fixing plate 42 is joined to the surface of the protective substrate 30 on which the drive circuit 120 is mounted. The sealing film 41 is made of material with flexibility and low stiffness and seals one side of the manifold portion 31. The fixing plate 42 is made of relatively rigid material. A region of the fixing plate 42 facing the manifold 100 is formed as a cavity 43 made by completely removing the region extending in the width direction and one side of the manifold 100 is sealed by only the flexible sealing film 41.

In the recording head 1 having such a configuration, when ink ejection is started, ink is introduced from a liquid supply unit and the flow channel from the manifold 100 to the nozzles 21 is filled with the ink. Afterwards, by applying voltage to the piezoelectric actuator 300 corresponding to the pressure generating chambers 12 in accordance with signals transmitted from the drive circuit 120, the vibrating plate 50 is distorted together with the piezoelectric actuator 300. As a result, the pressure inside the pressure generating chambers 12 increases and ink droplets are consequently ejected from corresponding ones of the nozzles 21.

Figure 5:
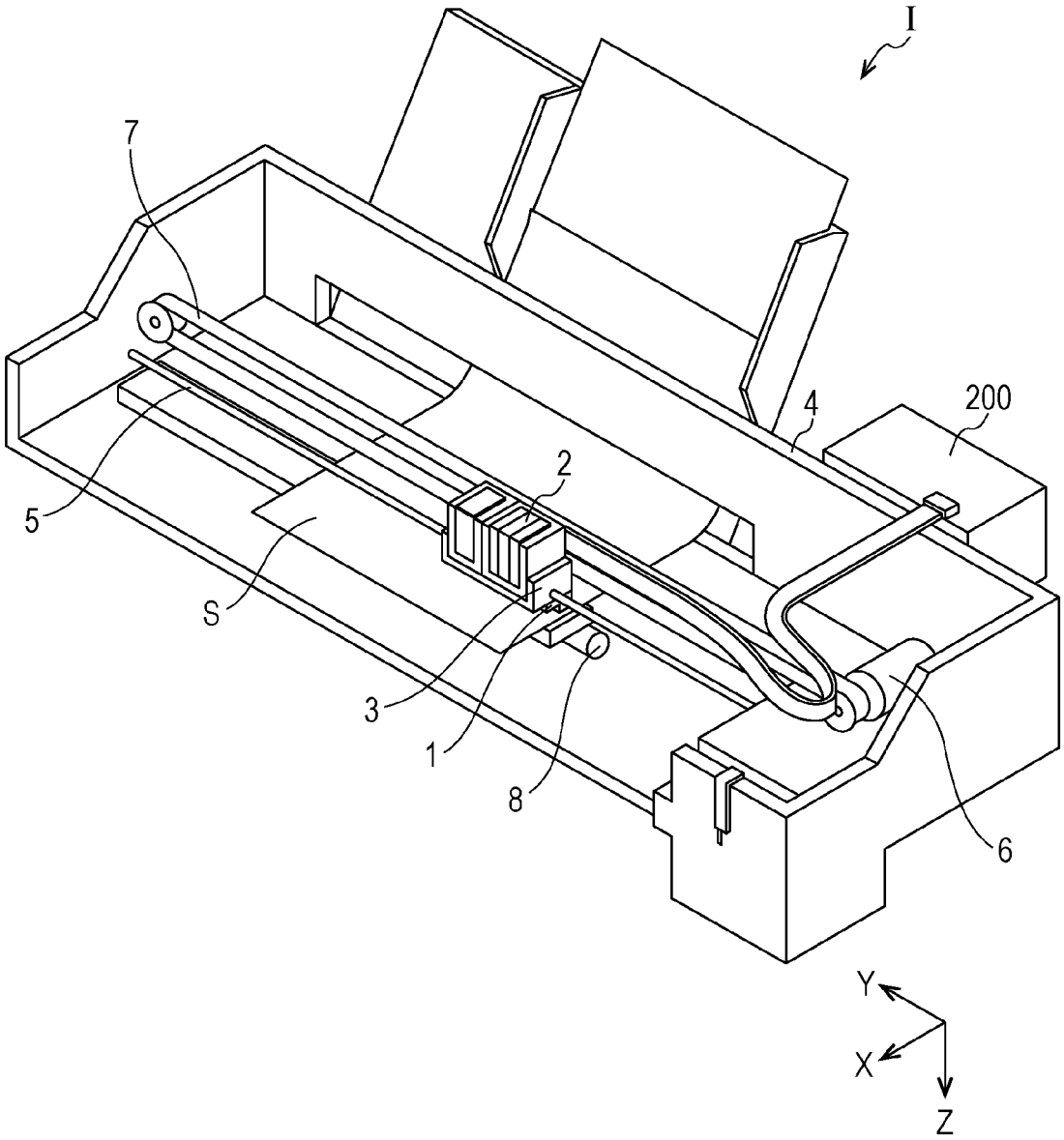
FIG. 5 illustrates a schematic configuration of an ink jet recording apparatus.

FIG. 5 illustrates a schematic configuration of an ink jet recording apparatus I as an example of a liquid ejecting apparatus according to the first embodiment of the present disclosure. It should be noted that in this embodiment the directions of the ink jet recording head 1 are described with respect to the directions of the ink jet recording head 1 when it is mounted on the ink jet recording apparatus I. Needless to say, the position of the recording head 1 in the ink jet recording apparatus I is not limited to the example described below.

As illustrated in FIG. 5, the ink jet recording apparatus I as an example of a liquid ejecting apparatus according to this embodiment includes a carriage 3 to which the recording head 1 described above is attached. The carriage 3 is movable along the axis of a carriage shaft 5 affixed to a main body 4. An ink cartridge 2 constituting the liquid supply unit is attached to the carriage 3 in a detachable manner.

Driving force of a drive motor 6 is transmitted to the carriage 3 via multiple gears not illustrated in the drawing and a timing belt 7, and as a result, the carriage 3 to which the recording head 1 is attached reciprocates along the carriage shaft 5 positioned along an axis of the second direction Y. In addition, a transport roller 8 serving as a transport unit is provided for the main body 4 and transports in the first direction X a recording sheet S that is a medium, such as a sheet of paper, and onto which ink is deposited. It should be noted that the transport unit that transports the recording sheet S is not limited to the transport roller 8 but may be a belt or a drum.

In the ink jet recording apparatus I having such a configuration, ink droplets are ejected from the recording head 1 while the recording sheet S is transported in the first direction X with respect to the recording head 1 and the carriage 3 reciprocates in the second direction Y with respect to the recording sheet S, such that printing is performed almost entirely on the recording sheet S.

Figure 6:
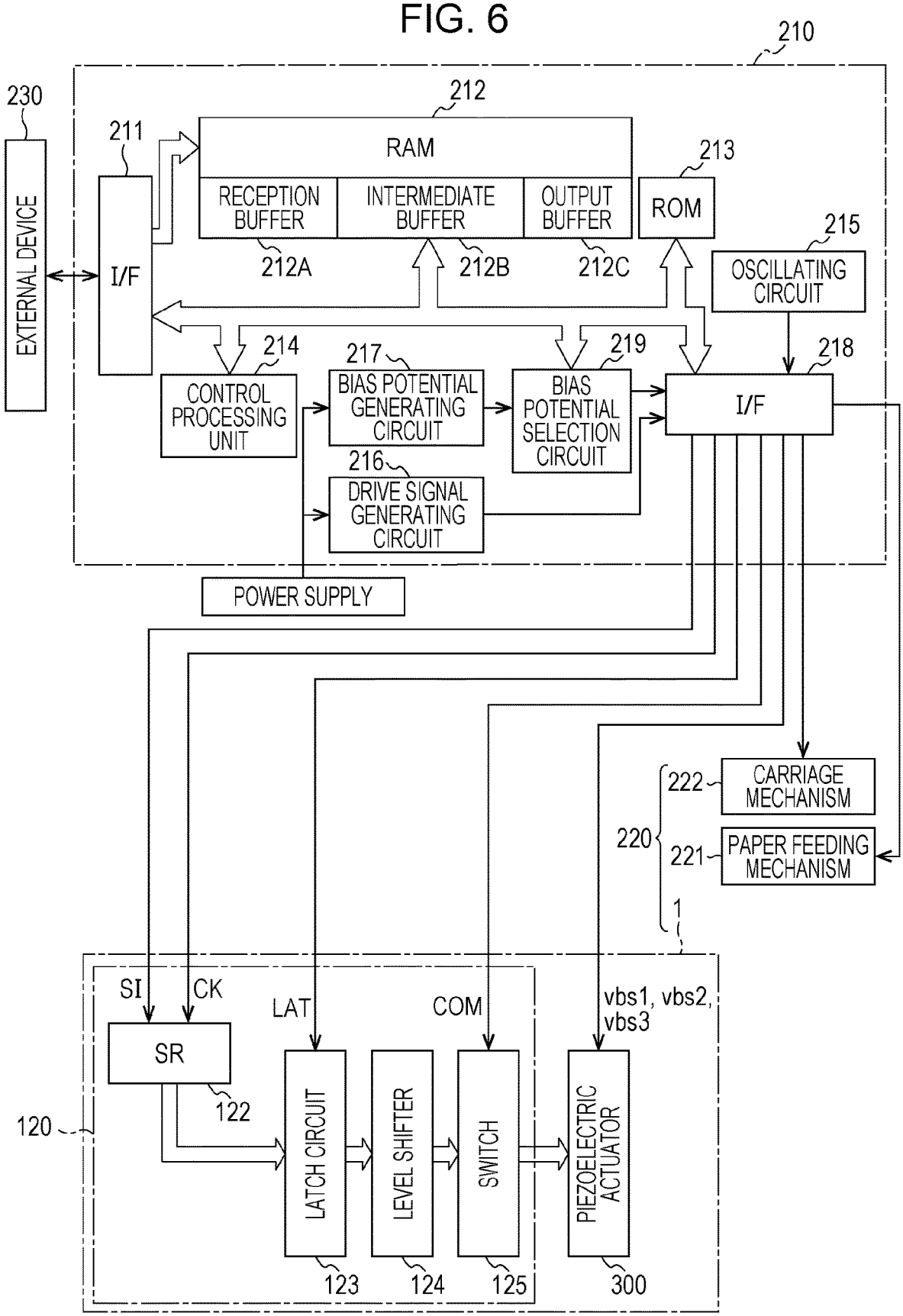
FIG. 6 is a block diagram illustrating an electrical configuration of the ink jet recording apparatus.
Figure 7:
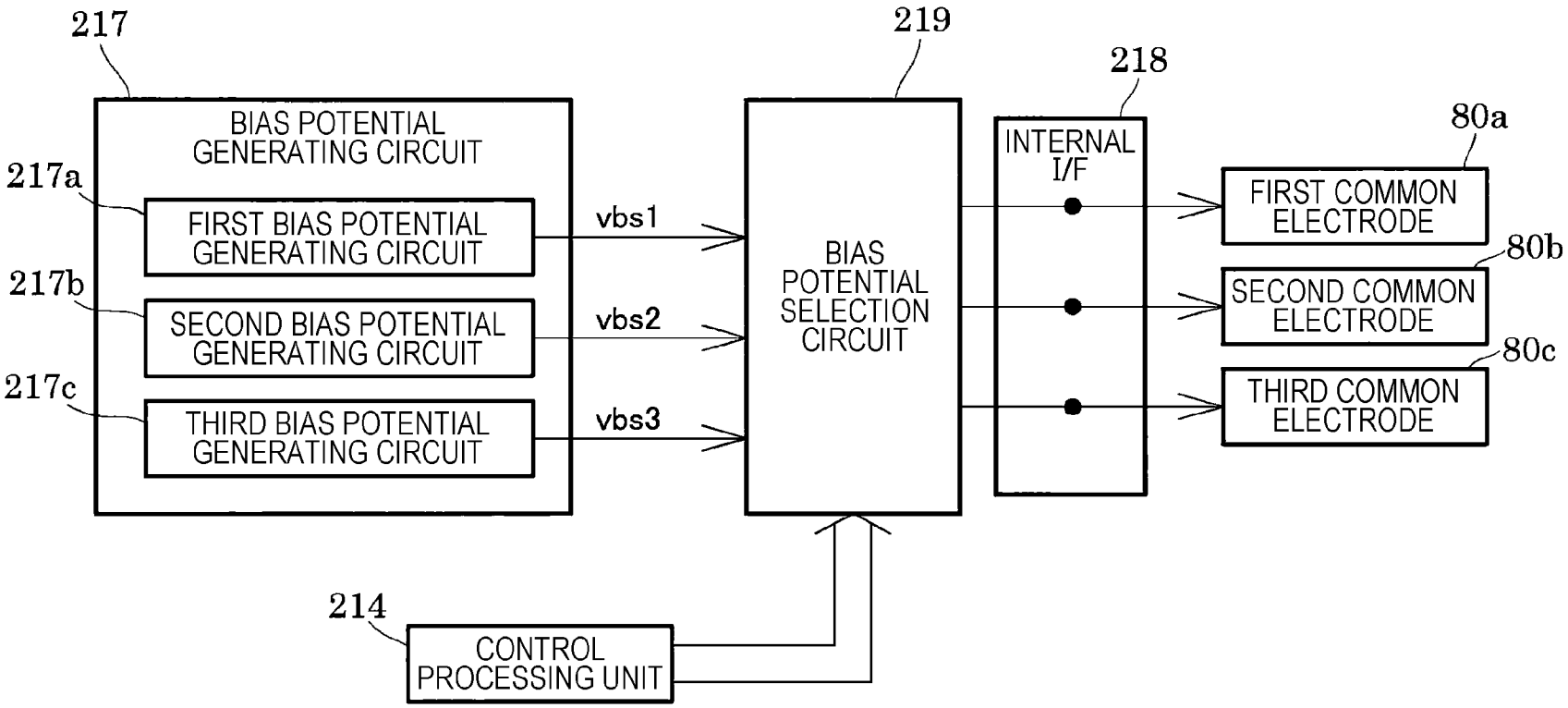
FIG. 7 is a functional block diagram of a bias potential generating circuit.

The ink jet recording apparatus I also includes the control device 200. Here, an electrical configuration according to this embodiment is described with reference to FIGS. 6 and 7. FIG. 6 is a block diagram illustrating an electrical configuration of the ink jet recording apparatus according to the first embodiment of the present disclosure. FIG. 7 is a functional block diagram illustrating a bias potential generating circuit.

As illustrated in FIG. 6, the ink jet recording apparatus I includes a printer controller 210 and a print engine 220. The printer controller 210 is a component for entirely controlling the ink jet recording apparatus I and installed in the control device 200 positioned inside the ink jet recording apparatus I in this embodiment.

The printer controller 210 includes an external interface 211 (hereinafter referred to as the external I/F 211), a random access memory (RAM) 212 that temporarily stores various types of data, a read only memory (ROM) 213 that stores, for example, a control program, a control processing unit 214 including, for example, a central processing unit (CPU), an oscillation circuit 215 that generates clock signals, a drive signal generating circuit 216 that generates drive signals to be supplied to the recording head 1, a bias potential generating circuit 217 that generates bias potential, a bias potential selection circuit 219 that selects bias potential, and an internal interface 218 (hereinafter referred to as the internal I/F 218) that transmits to the print engine 220, for example, dot pattern data (also known as bitmap data) developed in accordance with drive signals and print data.

The external I/F 211 receives, from an external device 230 such as a host computer, print data composed of, for example, character codes, graphics function, and image data. Additionally, busy signals (BUSY) and acknowledge signals (ACK) are output to the external device 230 via the external I/F 211.

The RAM 212 functions as a reception buffer 212A, an intermediate buffer 212B, an output buffer 212C, and work memory not illustrated in the drawing. The reception buffer 212A temporarily stores print data received by the external I/F 211. The intermediate buffer 212B stores intermediate code data converted by the control processing unit 214. The output buffer 212C stores dot pattern data. The dot pattern data is composed of printing data obtained by decoding (translating) tone data.

The ROM 213 previously stores, for example, font data and graphics functions, in addition to a control program (a control routine) for performing various types of data processing.

The control processing unit 214 reads print data stored in the reception buffer 212A and causes intermediate code data obtained by converting the print data to be stored in the intermediate buffer 212B. The control processing unit 214 also analyzes the intermediate code data read from the intermediate buffer 212B and develops the intermediate code data to dot pattern data by referring to the font data and the graphics functions stored in the ROM 213. The control processing unit 214 then performs necessary enhancement processing on the dot pattern data obtained by development and subsequently causes the dot pattern data to be stored in the output buffer 212C.

When the output buffer 212C obtains an entire unit of dot pattern data corresponding to one row with respect to the recording head 1, the unit of dot pattern data corresponding to one row is output to the recording head 1 via the internal I/F 218. After the unit of dot pattern data corresponding to one row is output from the output buffer 212C, the intermediate code data that has been developed is deleted from the intermediate buffer 212B and development processing is performed for the subsequent intermediate code data.

The drive signal generating circuit 216 generates a drive signal COM by using power supplied from outside. The bias potential generating circuit 217 generates a bias potential vbs to be supplied to the second electrode 80 serving as a common electrode of the piezoelectric actuator 300 by using power supplied from outside. Since in this embodiment the second electrode 80 is divided into three regions, namely the first common electrode 80*a*, the second common electrode 80*b*, and the third common electrode 80*c*, the bias potential generating circuit 217 can generate at least two different bias potentials. The bias potential generating circuit 217 according to this embodiment generates three different bias potentials. Specifically, as illustrated in FIG. 7, the bias potential generating circuit 217 according to this embodiment includes a first bias potential generating circuit 217*a* that generates a first bias potential vbs1, a second bias potential generating circuit 217*b* that generates a second bias potential vbs2, and the third bias potential generating circuit 217*c* that generates a third bias potential vbs3. The bias potential selection circuit 219 selects, with respective to each of the first common electrode 80*a*, the second common electrode 80*b*, and the third common electrode 80*c*, a particular one of the first bias potential vbs1, the second bias potential vbs2, and the third bias potential vbs3, which are generated respectively by the first bias potential generating circuit 217*a*, the second bias potential generating circuit 217*b*, and the third bias potential generating circuit 217*c*, in accordance with a control signal transmitted by the control processing unit 214. The designated bias potentials are supplied selectively to the first common electrode 80*a*, the second common electrode 80*b*, and the third common electrode 80*c* via the internal I/F 218. It should be noted that a first bias potential described in claims denotes a potential selected from the first bias potential vbs1, the second bias potential vbs2, and the third bias potential vbs3 and a second bias potential described in claims denotes another potential selected from the two potentials other than the potential selected as the first bias potential.

In this embodiment, by the first bias potential generating circuit 217*a*, the second bias potential generating circuit 217*b*, and the third bias potential generating circuit 217*c*, and the bias potential selection circuit 219 cooperating with each other, a particular one of the first bias potential vbs1, the second bias potential vbs2, and the third bias potential vbs3 is selected for each of the first common electrode 80*a*, the second common electrode 80*b*, the third common electrode 80*c* and supplied to the particular common electrode. In other words, the first bias potential generating circuit 217*a*, the second bias potential generating circuit 217*b*, and the third bias potential generating circuit 217*c*, and the bias potential selection circuit 219 cooperate with each other and output a bias potential to be input to the first region of the divided common electrode, which is in this embodiment an electrode selected from the first common electrode 80*a*, the second common electrode 80*b*, and the third common electrode 80*c*, and another bias potential to be input to the second region of the divided common electrode other than the first region, which is another electrode selected from the two electrodes other than the electrode having been selected as the first region. Specifically, a controller includes a first bias output unit that outputs a bias potential to be input to the first region of the divided common electrode and a second bias output unit that outputs a bias potential to be input to the second region other than the first region of the divided common electrode, in which the bias potential for the first bias output unit and the bias potential for the second bias output unit can be separately determined. Here, the configuration in which the bias potential for the first bias output unit and the bias potential for the second bias output unit can be separately determined denotes that the bias potential output from the first bias output unit and the bias potential output from the second bias output unit can be both determined to be the same level of potential or determined separately to be different levels of potential. With this configuration in which the bias potential for the first bias output unit and the bias potential for the second bias output unit can be separately determined, concerning the three regions formed by dividing the second electrode 80 serving as a common electrode in this embodiment, namely the first common electrode 80*a*, the second common electrode 80*b*, and the third common electrode 80*c*, the same bias potential may be supplied to all the three regions; the same bias potential may be supplied to two regions and a different bias potential may be supplied to another region; or three different bias potentials may be supplied to the three regions.

The print engine 220 includes the recording head 1, a paper feeding mechanism 221, and a carriage mechanism 222. The paper feeding mechanism 221 is composed of the transport roller 8 and a motor that drives the transport roller 8, and the like and feeds the recording sheet S forward along with recording operation performed by the recording head 1. Specifically, the paper feeding mechanism 221 moves the recording sheet S in the first direction X in a relative manner. The carriage mechanism 222 involves the carriage 3, the drive motor 6 that drives the carriage 3 to move along the carriage shaft 5 and an axis of the second direction Y, and the timing belt 7.

The recording head 1 is composed of the drive circuit 120 including a shift register 122, a latch circuit 123, a level shifter 124, and a switch 125, and the piezoelectric actuator 300. Although not illustrated in the drawings, the shift register 122, the latch circuit 123, the level shifter 124, the switch 125, and the piezoelectric actuator 300 are constituted by shift register components, latch components, level shifter components, switch components, the active portions 310, which are provided for the respective nozzles 21 of the recording head 1. The shift register 122, the latch circuit 123, the level shifter 124, the switch 125, and the active portion 310 are electrically coupled to each other in this order. The shift register 122, the latch circuit 123, the level shifter 124, and the switch 125 generate a pulse for application in accordance with a drive signal generated by the drive signal generating circuit 216. Here, the pulse for application is a pulse actually applied to the active portion 310 of the piezoelectric actuator 300.

It should be noted that in this embodiment the printer controller 210 and the drive circuit 120 correspond to the controller described in claims.

Figure 8:
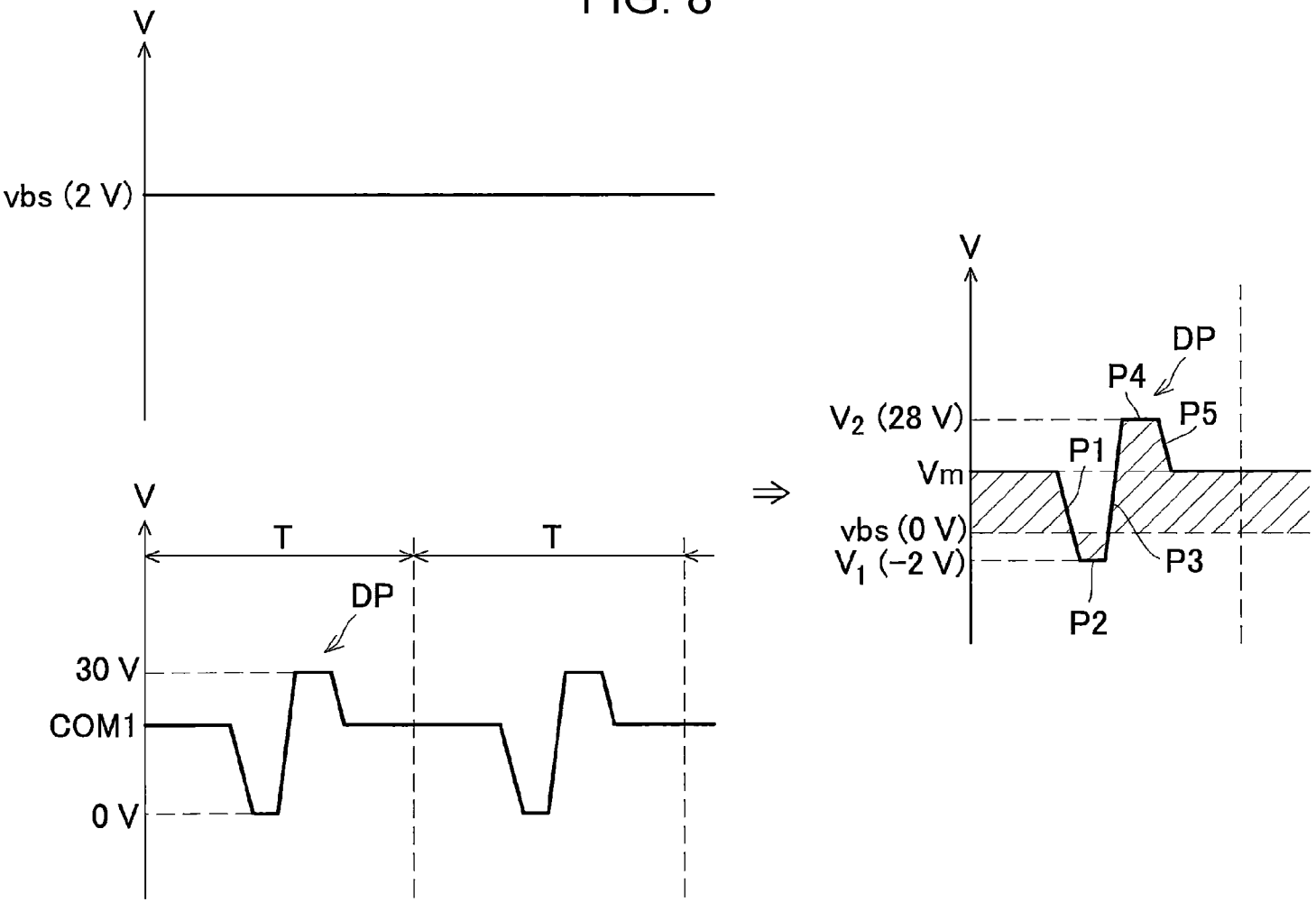
FIG. 8 illustrates a drive waveform representing a drive signal.

Here, a drive waveform representing a drive signal COM generated by the drive signal generating circuit 216 is described. FIG. 8 illustrates a drive waveform to explaining a bias potential, a drive signal, and a pulse for application.

As illustrated in FIG. 8, the drive signal COM according to this embodiment is repeatedly generated by the drive signal generating circuit 216 in every recording cycle period T. It should be noted that the recording cycle period T is also referred to as the discharging cycle period T and corresponds to one pixel of an image or the like printed on the recording sheet S. In this embodiment, the drive signal COM includes, in one discharging cycle period T, a discharge pulse DP for activating the active portion 310 so as to cause an ink droplet to be discharged from the nozzle 21 and is repeatedly generated in every discharging cycle period T.

When one row (one raster) of dot pattern is formed in the recording region of the recording sheet S in printing, the discharge pulse DP of the drive signal COM is applied selectively to the active portions 310 corresponding to the nozzles 21. Specifically, a pulse for application is generated in accordance with a head control signal and the drive signal COM with respect to each of the portions of the piezoelectric actuator 300 corresponding to the nozzles 21 and supplied to the corresponding active portion 310. The pulse for application is supplied to the first electrode 60 serving as an individual electrode for the active portion 310 of the piezoelectric actuator 300. In contrast, a bias potential (vbs) is supplied to the second electrode 80 serving as a common electrode of the multiple active portions 310 of the piezoelectric actuator 300. Accordingly, the voltage applied, based on the pulse for application, to the first electrode 60 serving as an individual electrode of the piezoelectric actuator 300 is expressed relative to the bias potential (vbs) that is applied to the second electrode 80 and used as a standard potential.

In the example illustrated in FIG. 8, in the case in which the drive signal COM includes the discharge pulse DP having 0 V minimum potential and 30 V maximum potential, when 2 V of the bias potential vbs is supplied to the second electrode 80, the discharge pulse DP having −2 V minimum potential and 28 V maximum potential of the pulse for application is supplied. In this embodiment, the 2 V bias potential is referred to as the first bias potential vbs1.

Here, the discharge pulse DP of the pulse for application includes a first expansion phase P1, a first expansion maintenance phase P2, a first contraction phase P3, a first contraction maintenance phase P4, and a first return phase P5: in the first expansion phase P1, the volume of the pressure generating chamber 12 is caused to expand relative to a standard volume by applying potential changing from an intermediate potential Vm to a first potential $V_1$ (−2 V in this example); in the first expansion maintenance phase P2, the volume of the pressure generating chamber 12 that has expanded in the first expansion phase P1 is maintained for a given period; in the first contraction phase P3, the volume of the pressure generating chamber 12 is caused to contract by applying potential changing from the first potential $V_1$ to a second potential $V_2$ (28 V in this example); in the first contraction maintenance phase P4, the volume of the pressure generating chamber 12 that has contracted in the first contraction phase P3 is maintained for a given period; and in the first return phase P5, the volume of the pressure generating chambers 12 returns from the contraction state in the second potential $V_2$ to the standard volume at the intermediate potential Vm. Accordingly, the drive voltage V of the pulse for application is −2 V of the first potential $V_1$ at a minimum voltage and 28 V of the second potential $V_2$ at a maximum voltage.

When such a pulse is applied to the active portion 310 of the piezoelectric actuator 300, in the first expansion phase P1 the piezoelectric actuator 300 changes in shape so as to cause the volume of the pressure generating chamber 12 to expand, and as a result, the meniscus in the nozzle 21 is pulled toward the pressure generating chamber 12 and ink is supplied to the pressure generating chamber 12 from the manifold 100 side. The expansion state of the pressure generating chambers 12 is maintained in the first expansion maintenance phase P2. Subsequently, by supplying the potential in the first contraction phase P3, the volume of the pressure generating chamber 12 that has expanded is rapidly caused to contract to the contraction volume associated with the second potential $V_2$, and as a result, ink in the pressure generating chambers 12 is pressurized and an ink droplet is discharged from the nozzle 21. The contraction state of the pressure generating chamber 12 is maintained in the first contraction maintenance phase P4 and the pressure on ink in the pressure generating chamber 12 that has decreased while ink droplet has been discharge in the phase is increased again due to the natural vibration of the pressure generating chamber 12. By supplying the potential in the first return phase P5 at the time of increasing of pressure, the volume of the pressure generating chamber 12 returns to the standard volume, so that the pressure change in the pressure generating chamber 12 is absorbed.

The drive signal COM is supplied, in accordance with printing data (SI) constituting dot pattern data, selectively to the active portion 310 of the piezoelectric actuator 300 corresponding to the nozzle 21 that discharge ink droplets every discharging cycle period T, and as a result, ink droplets are discharged.

Figure 9:
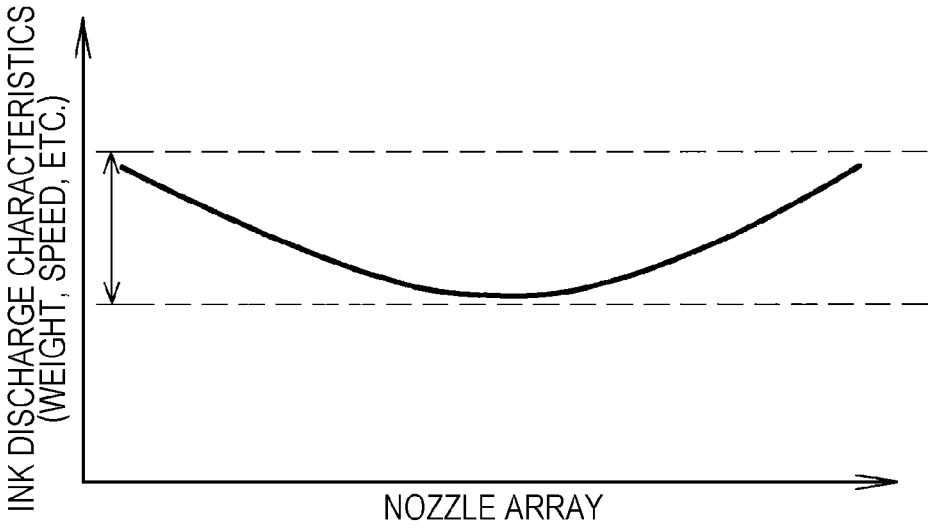
FIG. 9 is a graph illustrating variations of the degrees of ink discharge characteristics of a recording head according to a comparative example.

Here, in a recording head in which the second electrode 80 serving as a common electrode is not divided in the nozzle array 22, as illustrated in FIG. 9, due to voltage drop caused by the electrical resistance of the second electrode 80 serving as a common electrode, ink-droplet discharge characteristics, such as the weight of ink droplet and the ink jet speed, are degraded in the center area of the nozzle array 22 more than in both end areas of the nozzle array 22.

Figure 10:
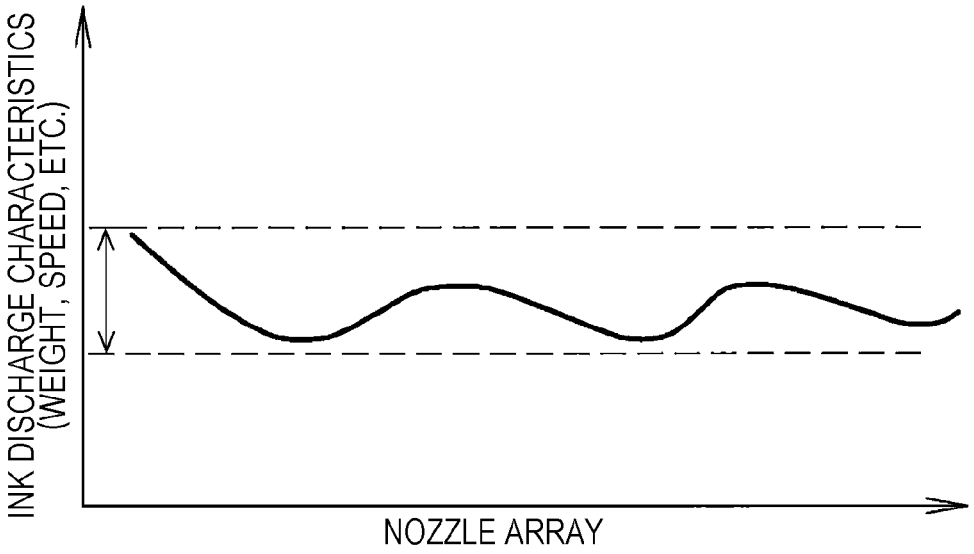
FIG. 10 is a graph illustrating variations of the degrees of ink discharge characteristics of a recording head according to another comparative example.

When voltage drop does not occur in the second electrode 80 serving as a common electrode, due to, for example, production variations of the piezoelectric actuator 300 and production variations of flow channel structure, as illustrated in FIG. 10, the degrees of ink-droplet discharge characteristics vary in a single nozzle array.

In consideration of these conditions, in this embodiment, the second electrode 80 serving as a common electrode of the recording head 1 is divided into at least two in the nozzle array 22 in a direction in which the nozzles 21 are arranged; the bias potential generating circuit 217 of the control device 200 generates the first bias potential vbs1, the second bias potential vbs2, and the third bias potential vbs3, which are bias potentials different from each other; and an optimum bias potential among the three bias potentials is supplied to each of the first common electrode 80*a*, the second common electrode 80*b*, and the third common electrode 80*c*, which are divided regions of the common electrode. This configuration reduces the variations between the degrees of characteristics of ink droplet discharged from a nozzle group corresponding to the first common electrode 80*a*, the degrees of characteristics of ink droplet discharged from a nozzle group corresponding to the second common electrode 80*b*, and the degrees of characteristics of ink droplet discharged from a nozzle group corresponding to the third common electrode 80*c*.

Figure 11:
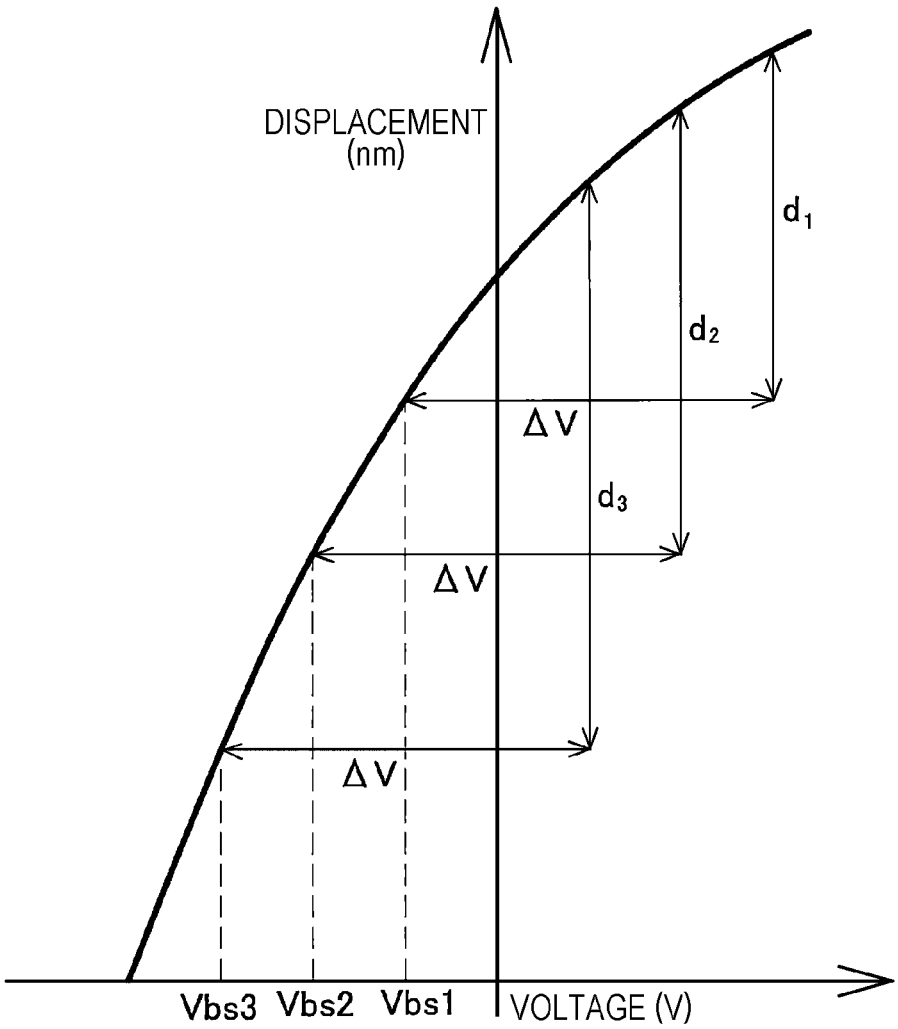
FIG. 11 is a graph illustrating the relationship between voltage and the degree of displacement.

Here, as seen from a butterfly curve representing the relationship between the potential (the voltage) at the first electrode 60 relative to the potential at the second electrode 80 used as the standard potential and voltage-induced strain (the degree of displacement) illustrated in FIG. 11, when ΔV is applied to the piezoelectric layer 70 of the active portion 310, by changing bias potential applied to the second electrode 80 from the first bias potential vbs1 (for example, 2 V) to the second bias potential vbs2 (for example, 4 V), the discharge pulse DP having −4 V minimum potential and 26

V maximum potential is supplied as the pulse for application, and as a result, as indicated by the different corresponding portions in the butterfly curve, the degree of displacement of the active portion 310 can be changed from $d_1$ to $d_2$. In the example in FIG. 11, the degree of displacement $d_2$ in the case of applying the second bias potential vbs2 is greater than the degree of displacement $d_1$ in the case of applying the first bias potential vbs1, that is, $d_2>d_1$, and thus, the degrees of ink-droplet discharge characteristics such as the weight of ink droplet and the ink jet speed can be increased in the case of applying the second bias potential vbs2 compared to the case of applying the first bias potential vbs1.

Similarly, by changing bias potential from the second bias potential vbs2 (for example, 4 V) to the third bias potential vbs3 (for example, 6 V), the discharge pulse DP having −6 V minimum potential and 24 V maximum potential is supplied as the pulse for application, and as a result, as indicated by the different corresponding portions in the butterfly curve, the degree of displacement of the active portion 310 can be changed from $d_2$ to $d_3$. In the example in FIG. 11, the degree of displacement $d_3$ in the case of applying the third bias potential vbs3 is greater than the degree of displacement $d_2$ in the case of applying the second bias potential vbs2, that is, $d_3>d_2$, and thus, the degrees of ink-droplet discharge characteristics such as the weight of ink droplet and the ink jet speed can be increased in the case of applying the third bias potential vbs3 compared to the case of applying the second bias potential vbs2.

Thus, the degrees of ink-droplet discharge characteristics can be varied by changing the level of bias potential to be supplied. In this embodiment, as the bias potential increases, the degrees of ink-droplet discharge characteristics increase.

Accordingly, by selectively applying any of the first bias potential vbs1, the second bias potential vbs2, and the third bias potential vbs3 to each divided region of the common electrode such as the first common electrode 80*a*, the second common electrode 80*b*, and the third common electrode 80*c*, variations of the degrees of ink-droplet discharge characteristics in the nozzle array 22 can be reduced.

Figure 12:
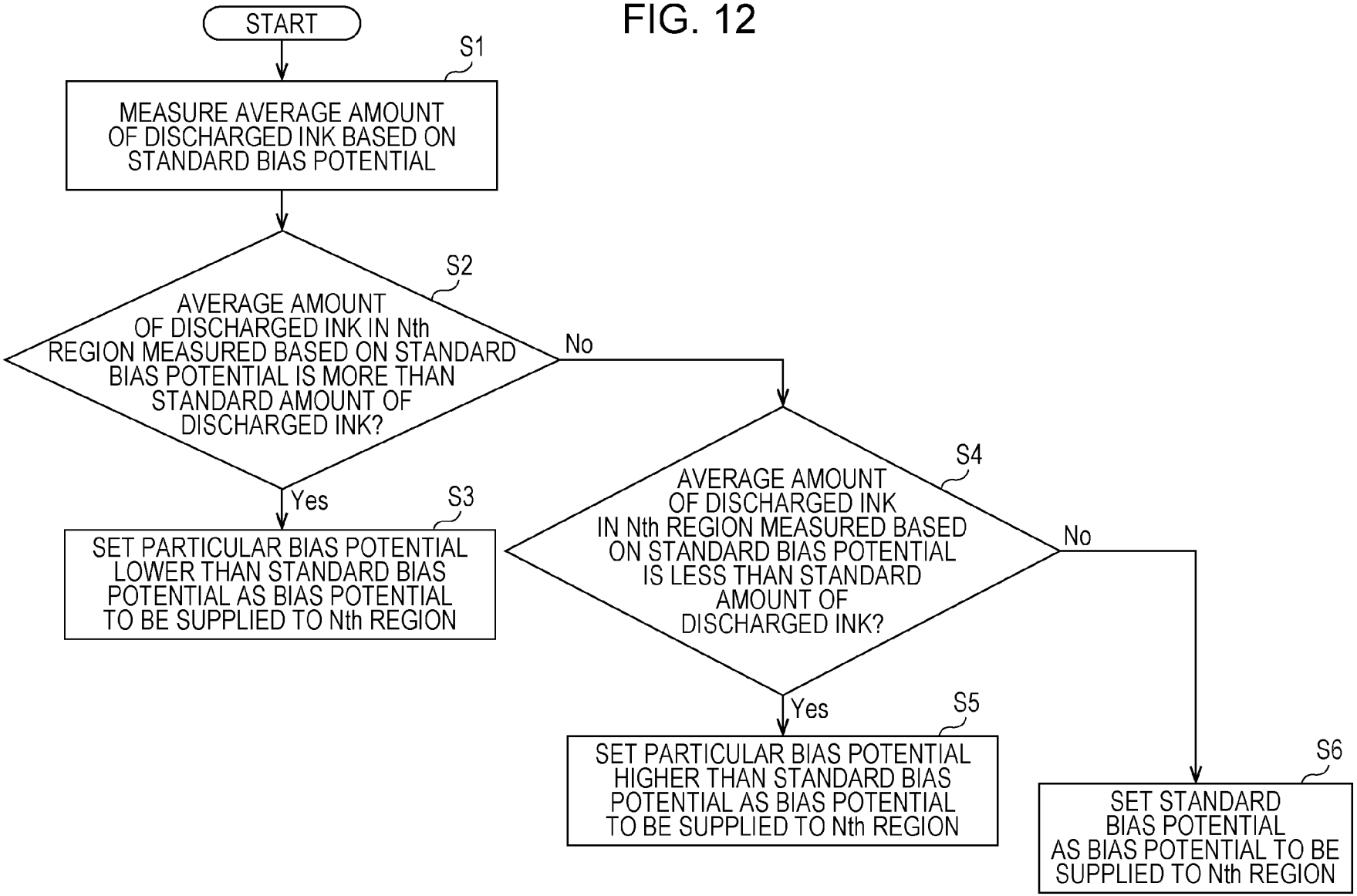
FIG. 12 a flowchart illustrating a method for setting bias potential.
Figure 13:
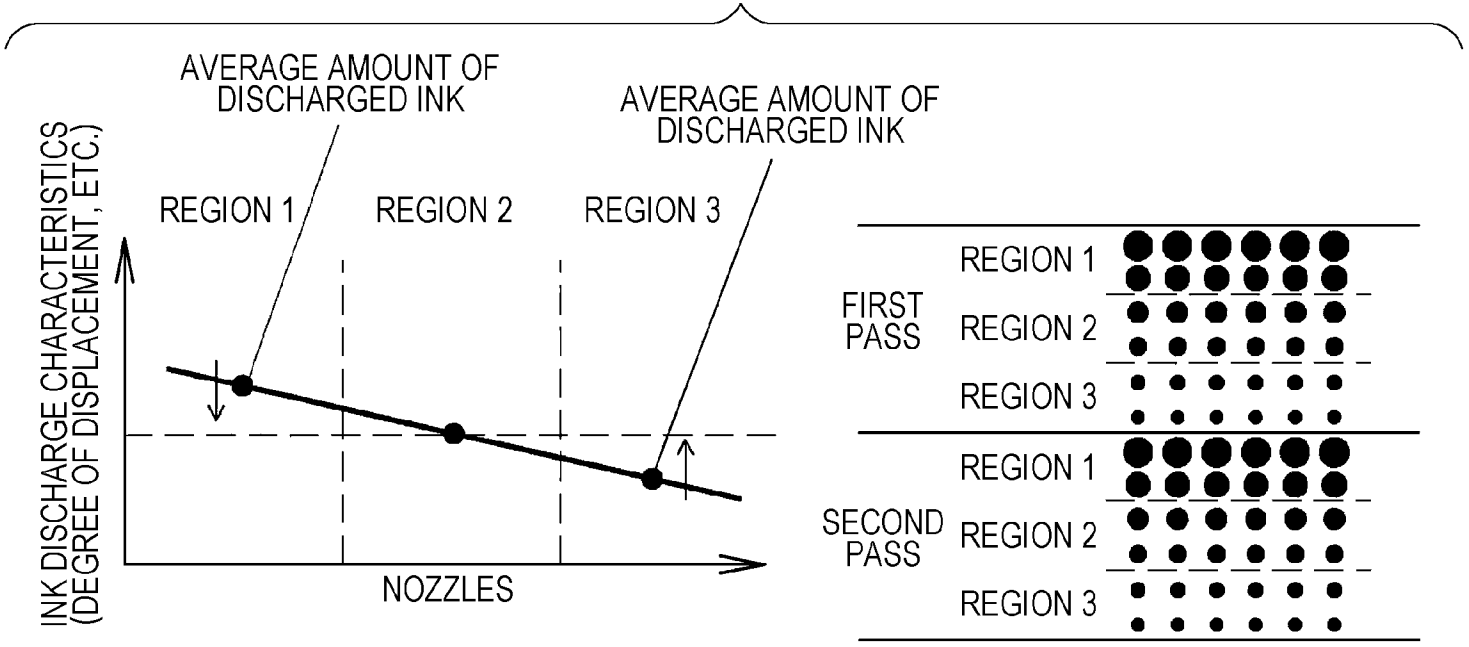
FIG. 13 is a graph about ink discharge characteristics and a pixel forming image.
Figure 14:
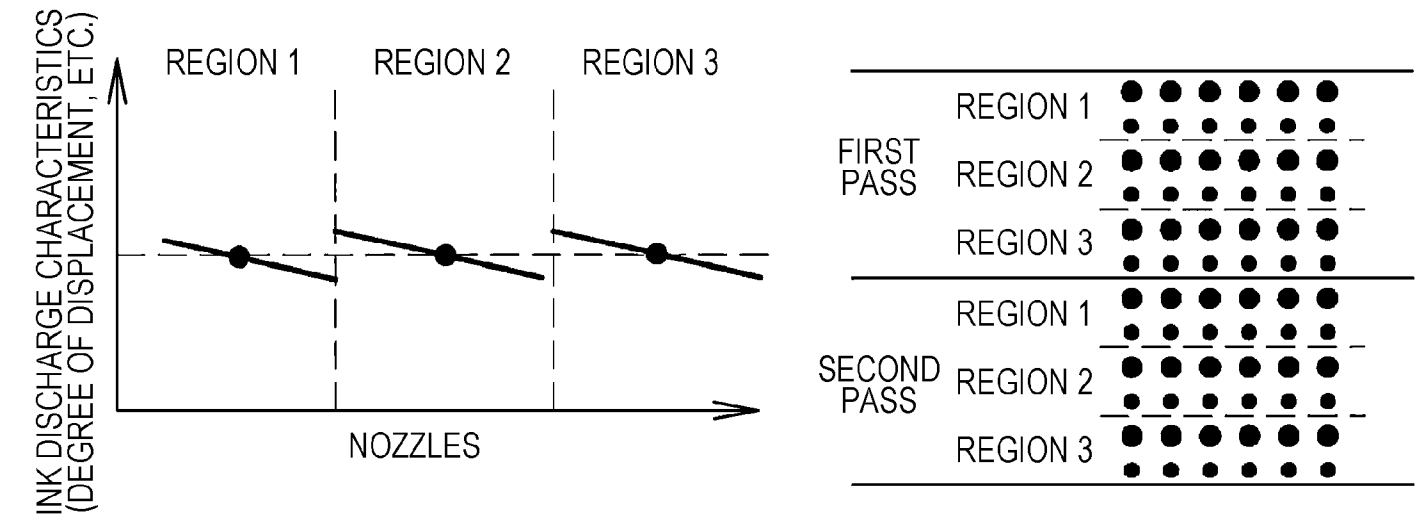
FIG. 14 is another graph about ink discharge characteristics and another pixel forming image.

A method for setting bias potential is described below with reference to FIGS. 12 to 14. FIG. 12 is a flowchart illustrating a method for setting bias potential. FIGS. 13 and 14 are graphs about a nozzle array and ink discharge characteristics and pixel forming images when printing.

As explained in step S1 in FIG. 12, by applying a drive signal, that is, a pulse for application, based on a standard bias potential, the average amount of discharged ink is measured with respect of each nozzle group in a region obtained by dividing a common electrode. The nozzle group is composed of the nozzles 21 corresponding to the active portions 310 sharing a region obtained by dividing a common electrode as described above. The value of the average amount of discharged ink is obtained by calculating an average value of the measured weights of ink droplet discharged from the respective nozzles 21 constituting the nozzle group. While any level of potential can be used as the standard bias potential, the second bias potential vbs2 is used as the standard bias potential in this embodiment. When the second bias potential vbs2 serving as the standard bias potential is used for drive, as illustrated in FIG. 13, the degrees of ink-droplet discharge characteristics are gradually decreased in the nozzle array 22 in a direction from a region 1 on one end side to a region 3 on the other end side. It should be noted that the regions 1 to 3 denote the respective regions formed by dividing the second electrode 80 serving as a common electrode and correspond respectively to the first common electrode 80*a*, the second common electrode 80*b*, and the third common electrode 80*c* in this embodiment.

Next, as explained in step S2, it is determined whether the measured average amount of discharged ink corresponding to an Nth region is more than the standard amount of discharged ink. The standard amount of discharged ink may be, for example, a designed target value in the case of driving by a standard bias potential, the average amount of discharged ink in the case of driving the multiple recording heads 1 having the same structure by a standard bias potential, or the average amount of discharged ink ejected from all the nozzles 21 of the nozzle array 22. In this embodiment, the average amount of discharged ink corresponding to the region 2 that is in the middle among three kinds of measured average amount of discharged ink, that is, the average amount of discharged ink corresponding to the second common electrode 80*b* is used as the standard amount of discharged ink.

Subsequently, when it is determined that the average amount of discharged ink measured with respect to the Nth region is more than the standard amount of discharged ink (Yes in step S2), a bias potential lower than the standard bias potential is set as the bias potential to be supplied to the common electrode of the Nth region in step S3. For example, since the average amount of discharged ink ejected from the nozzle group corresponding to the first common electrode 80*a* of the region 1 as the first region is more than the average amount of discharged ink ejected from the nozzle group corresponding to the second common electrode 80*b* of the region 2 serving as the standard, the first bias potential vbs1 lower than the second bias potential vbs2 serving as the standard is set as the bias potential to be supplied to the first common electrode 80*a*. As a result, in this embodiment, by supplying the first bias potential vbs1 to the first common electrode 80*a*, the difference between the average amount of discharged ink droplets ejected from the nozzle group corresponding to the first common electrode 80*a* and the average amount of discharged ink droplets ejected from the nozzle group corresponding to the second common electrode 80*b* in the case of supplying the second bias potential vbs2 to the second common electrode 80*b* is smaller than the difference in the average amount of discharged ink droplets between the first common electrode 80*a* and the second common electrode 80*b* in the case of supplying the same second bias potential vbs2 to both electrodes.

By contrast, when the average amount of discharged ink measured with respect to the Nth region is not more than the standard amount of discharged ink (No in step S2), in other words, the average amount of discharged ink measured with respect to the Nth region is equal to or less than the standard amount of discharged ink, it is determined in step S4 whether the average amount of discharged ink measured with respect to the Nth region is less than the standard amount of discharged ink. For example, the region 2 as the second region and the region 3 as the third region illustrated in FIG. 13 are applicable to the above case.

When it is determined that the average amount of discharged ink measured with respect to the Nth region is less than the standard amount of discharged ink (Yes in step S4), a bias potential higher than the standard bias potential is set as the bias potential to be supplied to the common electrode of the Nth region in step S5. For example, since the average amount of discharged ink of the nozzle group corresponding to the third common electrode 80*c* of the region 3 as the third region is less than the average amount of discharged ink of the nozzle group corresponding to the second common electrode 80*b* of the region 2 serving as the standard, the third bias potential vbs3 higher than the second bias potential vbs2 serving as the standard is set as the bias potential to be supplied to the third common electrode 80*c*. As a result, in this embodiment, by supplying the third bias potential vbs3 to the third common electrode 80*c*, the difference between the average amount of discharged ink droplets ejected from the nozzle group corresponding to the third common electrode 80*c* and the average amount of discharged ink droplets ejected from the nozzle group corresponding to the second common electrode 80*b* in the case of supplying the second bias potential vbs2 to the second common electrode 80*b* is smaller than the difference in the average amount of discharged ink droplets between the third common electrode 80*c* and the second common electrode 80*b* in the case of supplying the same second bias potential vbs2 to both electrodes.

By contrast, when the average amount of discharged ink measured with respect to the Nth region is not less than the standard amount of discharged ink (No in step S4), the average amount of discharged ink measured with respect to the Nth region is equal to the standard amount of discharged ink, and thus, the second bias potential vbs2 serving as the standard is set as the bias potential to be supplied to the common electrode of the Nth region in step S6. For example, in the region 2 as the second region, the average amount of discharged ink droplets in the case of supplying the second bias potential vbs2 to the second common electrode 80*b* of the region 2 is used as the standard, and therefore, the second bias potential vbs2 serving as the standard is supplied to the second common electrode 80*b*.

These processes in steps S1 to S4 are repeatedly performed for the respective regions formed by dividing the common electrode, and consequently, a bias potential is set for each of the regions formed by dividing the common electrode.

By setting bias potential with respect to each of the first common electrode 80*a*, the second common electrode 80*b*, and the third common electrode 80*c*, variations of the degrees of ink-droplet discharge characteristics in the nozzle array 22 can be reduced as illustrated in FIG. 14. In particular, as illustrated in FIG. 13, when the degrees of ink-droplet discharge characteristics change gradually in one direction in the nozzle array 22, in the case of single pass printing in which printing is performed while the carriage 3 is caused to reciprocate ink in a scan direction, the difference in the weight of ink droplet between the region 3 as the third region in the first pass and in the region 1 as the first region in the second pass is most considerable, likely resulting in uneven printing. However, as illustrated in FIG. 14, the configuration in this embodiment decreases the difference in the weight of ink droplet between the third common electrode 80*c* and the first common electrode 80*a*, and as a result, uneven printing is less likely to occur between the region 3 as the third region in the first pass and the region 1 as the first region in the second pass. Consequently, in this embodiment, variations of the degrees of ink discharge characteristics are reduced, and therefore, the occurrence of uneven printing in single pass printing is hindered and print quality can be improved.

In this embodiment, the bias potential generating circuit 217 generates three different bias potentials that are the first bias potential vbs1, the second bias potential vbs2, and the third bias potential vbs3 and supplies the first bias potential vbs1 to the first common electrode 80*a*, the second bias potential vbs2 to the second common electrode 80*b*, and the third bias potential vbs3 to the third common electrode 80*c*, but this configuration should not be construed in a limiting sense. For example, when the degrees of ink discharge characteristics are at substantially the same levels in the both end areas of the nozzle array 22 and the degrees of the ink discharge characteristics in the center portion is at lower levels relative to the both end areas as illustrated in FIG. 9, a particular bias potential, for example, the first bias potential vbs1 may be applied to the both end areas and another bias potential different from the particular bias potential for the both end areas, for example, in this embodiment, the second bias potential vbs2 or the third bias potential vbs3, by which a greater degree of displacement is induced compared to the first bias potential vbs1, may be applied to the center portion. Thus, bias potentials supplied to the regions formed by dividing the common electrode are not necessarily different from each other and the same bias potential may be supplied to any multiple regions of the regions formed by dividing the common electrode for the purpose of balancing the degrees of ink-droplet discharge characteristics among the multiple regions. Accordingly, the second electrode 80 serving as a common electrode only needs to be divided into at least two and the bias potential generating circuit 217 only needs to generate at least two different levels of bias potentials, so that variation of the degrees of ink discharge characteristics can be reduced. In other words, by selecting, with respect to each region obtained by dividing the common electrode into at least two, a bias potential from at least two different bias potentials and supplying the particular region, variations of the degrees of ink-droplet discharge characteristics can be decreased. Needless to say, when the second electrode 80 serving as a common electrode is divided into multiple regions and the degrees of ink-droplet discharge characteristics are at substantially the same levels in the nozzle array 22, the same bias potential may be supplied to the multiple regions formed by dividing the common electrode. As described above, in the recording head 1, when the common electrode is divided into at least two regions in the single nozzle array 22 in a direction in which the nozzles 21 are arrayed, in the case in which the degrees of ink-droplet discharge characteristics vary among the multiple regions, different bias potentials can be supplied to the multiple regions so as to reduce variations of the degrees of ink discharge characteristics. Thus, it is unnecessary to discard the recording head 1 due to variations of the degrees of ink discharge characteristics, and therefore, the manufacturing yield of the recording head 1 can be improved. Furthermore, in this embodiment, only bias potential needs to be changed and the common drive signal COM is supplied to the respective active portions 310 in the nozzle array 22, and hence, it is unnecessary to generate multiple different kinds of the drive signal COM and to prepare multiple pieces of the drive signal generating circuit 216. Therefore, variations of the degrees of ink-droplet discharge characteristics can be reduced by using a simple circuit, resulting in the decrease in the cost.

The ink jet recording head 1 as the liquid ejecting head according to this embodiment includes the nozzle array 22 composed of the nozzles 21 that are aligned and configured to discharge ink as liquid, the flow channel substrate 10 in which the pressure generating chambers 12 communicating with the nozzles 21 in the nozzle array 22 are formed, and the piezoelectric actuator 300 that is positioned on one side of the flow channel substrate 10 and that includes the first electrode 60, the piezoelectric layer 70, and the second electrode 80. The piezoelectric actuator 300 includes the active portions 310 that are each a portion of the piezoelectric layer 70, the portion being sandwiched by the first electrode 60 and the second electrode 80, and that are positioned to correspond individually to the pressure generating chambers 12. Any one electrode of the first electrode 60 and the second electrode 80 serves as individual electrodes provided individually for the respective active portions 310. Another electrode of the first electrode 60 and the second electrode 80 serves as a common electrode provided to be shared by the multiple active portions 310. The common electrode is divided into at least two regions in the single nozzle array 22 in a direction in which the nozzles 21 are aligned.

By dividing the common electrode into at least two regions in the single nozzle array 22 in a direction in which the nozzles 21 are aligned, either different bias potentials or the same bias potential may be supplied to the at least two regions of the common electrode. As a result, the recording head 1 can be driven so as to reduce variations of the degrees of discharge characteristics of ink droplets as liquid in the nozzle array 22, and therefore, print quality can be improved. In addition, it is unnecessary to discard the recording head 1 due to variations of the degrees of ink discharge characteristics in the nozzle array 22, and therefore, the yield of the recording head 1 can be improved.

Additionally, since variations of the degrees of ink-droplet discharge characteristics can be reduced by only supplying an identical bias potential or different bias potentials to the divided common electrode, it is unnecessary to supply different drive signals to the individual electrodes of the recording head 1, and thus, the reduction of variations of the degrees of ink-droplet discharge characteristics can be achieved by using a simple circuit, resulting in the reduction of the cost.

Furthermore, in the ink jet recording head 1 according to this embodiment, the regions of the divided common electrode may be coupled separately to individual input terminals. With this configuration, either different bias potentials or an identical bias potential can be supplied from the individual input terminals to the regions of the divided common electrode, resulting in increased flexibility.

Moreover, in the ink jet recording head 1 according to this embodiment, the common electrode may be divided into at least one end region, another end region, a middle region between the one end region and the other end region in the nozzle array 22. With this configuration, by dividing the common electrode into the three regions among which the degrees of ink-droplet discharge characteristics likely vary in the nozzle array 22, the variations of the degrees of ink discharge characteristics can be effectively reduced. Needless to say, the second electrode 80 serving as a common electrode is not necessarily divided into three regions and may be divided into two, four, or more. Variations of the degrees of ink-droplet discharge characteristics in the nozzle array 22 can be suppressed more when the common electrode is divided into four or more, but this configuration needs more complex control and it is therefore preferable to divide the common electrode into three regions as in this embodiment.

Further, the ink jet recording head 1 according to this embodiment may include the manifold 100 as a common liquid chamber that communicates with all the pressure generating chambers 12 communicating with the nozzles 21 constituting the nozzle array 22. This configuration reduces variations of the degrees of ink-droplet discharge characteristics in the nozzle array 22 composed of the nozzles 21 that all discharge ink as identical liquid, and therefore, print quality can be improved.

Furthermore, in the ink jet recording head 1 according to this embodiment, the common electrode is formed to cover, with respect to each of the pressure generating chambers 12, a region between a particular one of the pressure generating chambers 12 and adjacent another of the pressure generating chambers 12. With this configuration, the end of the common electrode is not positioned at a region facing the pressure generating chamber 12, and as a result, the concentration of stress at the end of the common electrode can be suppressed and the occurrence of damage thus can be hindered.

The ink jet recording apparatus I as the liquid ejecting apparatus according to this embodiment includes the ink jet recording head 1 serving as the liquid ejecting head described above and a controller that supplies the drive signal COM common to the nozzle array 22 selectively to the individual electrodes of the piezoelectric actuator 300 and that supplies a bias potential to the common electrode.

Since the controller does not need to supply different drive signals to the individual electrodes in the recording head 1, variations of the degrees of ink discharge characteristics can be reduced by using a simple circuit, consequently resulting in the reduction of the cost.

Moreover, in the ink jet recording apparatus I according to this embodiment, the controller may supply the first bias potential to the first region of the divided common electrode and the second bias potential different from the first bias potential to the second region of the divided common electrode, the second region being different from the first region. With this configuration, the common electrode is divided into at least two regions in the single nozzle array 22 in a direction in which the nozzles 21 are aligned and different bias potentials are supplied to the first region and the second region, and as a result, the recording head 1 can be driven so as to reduce variations of the degrees of discharge characteristics of ink droplets as liquid in the nozzle array 22, and therefore, print quality can be improved.

Further, in the ink jet recording apparatus I according to this embodiment, the controller may include a first bias output unit that outputs a bias potential to be input to the first region of the divided common electrode and a second bias output unit that outputs a bias potential to be input to the second region other than the first region of the divided common electrode, in which the bias potential for the first bias output unit and the bias potential for the second bias output unit can be separately determined. By dividing the common electrode into at least two regions in the single nozzle array 22 in a direction in which the nozzles 21 are aligned and outputting the first bias potential from the first bias output unit and the second bias potential from the second bias output unit, different bias potentials or the same bias potential may be supplied to the at least two regions of the common electrode. As a result, the recording head 1 can be driven so as to reduce variations of the degrees of discharge characteristics of ink droplets as liquid in the nozzle array 22, and therefore, print quality can be improved.

Furthermore, in the ink jet recording apparatus I according to this embodiment, the difference between the average amount of discharged ink as liquid ejected from a first nozzle group constituted by particular nozzles of the nozzles 21, the particular nozzles corresponding to particular active portions that are among the active portions 310 and share the first region as a common electrode, and the average amount of discharged ink ejected from a second nozzle group constituted by other particular nozzles of the nozzles 21, the other particular nozzles corresponding to other particular active portions that are among the active portions 310 that share the second region as a common electrode, may be smaller than the difference between the average amount of discharged ink ejected from the first nozzle group and the average amount of discharged ink ejected from the second nozzle group when the drive signal COM is applied while an identical bias potential is supplied to both the first region and the second region.

In this embodiment, for example, when the first region denotes the first common electrode 80*a* and the second region denotes the second common electrode 80*b*, the difference between the average amount of discharged ink droplets ejected from the first nozzle group corresponding to the first common electrode 80*a* when the first bias potential vbs1 is supplied to the first common electrode 80*a* and the average amount of discharged ink droplets ejected from the second nozzle group corresponding to the second common electrode 80*b* when the second bias potential vbs2 is supplied to the second common electrode 80*b* is less than the difference between the average amount of discharged ink ejected from the first nozzle group and the average amount of discharged ink ejected from the second nozzle group when the drive signal COM is applied while an identical bias potential, that is, the second bias potential vbs2 in this embodiment, is supplied to both the first common electrode 80*a* and the second common electrode 80*b*. With this configuration, different bias potentials are supplied to the first region and the second region so as to decrease, compared to the case in which an identical bias potential is supplied to both the first region and the second region, the difference between the average amount of discharged ink droplets ejected from the nozzle group corresponding to the first region and the average amount of discharged ink droplets ejected from the nozzle group corresponding to the second region, and as a result, print quality can be improved.

The same configuration can be applied to the case in which the first region denotes the second common electrode 80*b* and the second region denotes the third common electrode 80*c* and variations of the degrees of ink-droplet discharge characteristics can be reduced also in this case, and therefore, print quality can be improved.

Moreover, in the ink jet recording apparatus I according to this embodiment, when the drive signal COM is applied based on an identical bias potential, in the case in which the average amount of discharged ink ejected from the first nozzle group constituted by particular nozzles of the nozzles 21, the particular nozzles corresponding to particular active portions that are among the active portions 310 and shares the first region as a common electrode is more than the average amount of discharged ink ejected from the second nozzle group constituted by other particular nozzles of the nozzles 21, the other particular nozzles corresponding to other particular active portions that are among the active portions 310 and shares the second region as a common electrode, the first bias potential may be lower than the second bias potential.

In this embodiment, for example, when the first region denotes the first common electrode 80*a* and the second region denotes the second common electrode 80*b* and the second bias potential vbs2 is used as an identical bias potential for driving, in the case in which, as illustrated in FIG. 13, the average amount of discharged ink ejected from the first nozzle group corresponding to the first common electrode 80*a* is more than the average amount of discharged ink ejected from the second nozzle group corresponding to the second common electrode 80*b*, the first bias potential vbs1 lower than the second bias potential vbs2 is supplied as the first bias potential to the first common electrode 80*a*. This configuration effectively reduces variations of the degrees of discharge characteristics of ink droplets ejected from the first region and the second region.

The same configuration can also be applied to the case in which the first region denotes the second common electrode 80*b* and the second region denotes the third common electrode 80*c*, and by setting optimum bias potential, variations of the degrees of discharge characteristics of ink droplets ejected from the first region and the second region can be reduced also in this case.

In the method for setting bias potential in the ink jet recording head 1 as the liquid ejecting head according to this embodiment, the ink jet recording head 1 includes the nozzle array 22 composed of the nozzles 21 that are aligned and configured to discharge ink as liquid, the flow channel substrate 10 in which the pressure generating chambers 12 communicating with the nozzles 21 in the nozzle array 22 are formed, and the piezoelectric actuator 300 that is positioned on one side of the flow channel substrate 10 and that includes the first electrode 60, the piezoelectric layer 70, and the second electrode 80. The piezoelectric actuator 300 includes the active portions 310 that are each a portion of the piezoelectric layer 70, the portion being sandwiched by the first electrode 60 and the second electrode 80, and that are positioned to correspond individually to the pressure generating chambers 12. Any one electrode of the first electrode 60 and the second electrode 80 serves as individual electrodes provided individually for the respective active portions 310. Another electrode of the first electrode 60 and the second electrode 80 serves as a common electrode provided to be shared by the multiple active portions 310. The common electrode is divided into at least two regions in the nozzle array 22 in a direction in which the nozzles 21 are aligned and the divided common electrode includes the first region and the second region. The drive signal COM common to the nozzle array 22 is supplied selectively to the individual electrodes of the piezoelectric actuator 300 and a bias potential is supplied to the common electrode. The method for setting bias potential in the ink jet recording head 1 as the liquid ejecting head according to this embodiment includes measuring the average amount of discharged ink as liquid ejected from the first nozzle group constituted by particular nozzles of the nozzles 21, the particular nozzles corresponding to particular active portions that are among the active portions 310 and share the first region as a common electrode and the average amount of discharged ink as liquid ejected from the second nozzle group constituted by other particular nozzles of the nozzles 21, the other particular nozzles corresponding to other particular active portions that are the active portions 310 and share the second region as a common electrode when the drive signal COM is applied while a standard bias potential is supplied, and determining, with respect to each of the first region and the second region, a bias potential in accordance with the result of comparing the measured average amount of discharged ink with a standard amount of discharged ink.

In this configuration, the common electrode is divided into at least two regions in the single nozzle array 22 in a direction in which the nozzles 21 are aligned and bias potential is determined to reduce the difference in the average amount of discharged ink droplets among the nozzle groups corresponding to the regions obtained by division, and as a result, the recording head 1 can be driven by the determined bias potential so as to reduce variations of the degrees of discharge characteristics of ink droplets as liquid in the nozzle array 22, and therefore, print quality can be improved. In addition, it is unnecessary to discard the recording head 1 due to variations of the degrees of ink discharge characteristics in the nozzle array 22, and therefore, the yield of the recording head 1 can be improved.

Additionally, since the difference in the average amount of discharged ink droplets among the regions of the divided common electrode can be reduced by only setting appropriate bias potential, it is unnecessary to supply different drive signals to the individual electrodes of the recording head 1, and thus, the reduction of variations of the degrees of ink discharge characteristics can be achieved by using a simple circuit, resulting in the reduction of the cost.

Further, in the method for setting bias potential in the ink jet recording head 1 according to this embodiment, a particular bias potential lower than a standard bias potential may be determined as the bias potential when the measured average amount of discharged ink is more than the standard amount of discharged ink. This configuration can set an optimum bias potential, and as a result, variations of the degrees of discharge characteristics of ink droplets ejected from the nozzles corresponding to each region of the divided common electrode can be effectively reduced.

Furthermore, in the method for setting bias potential in the ink jet recording head 1 according to this embodiment, a particular bias potential higher than a standard bias potential may be determined as the bias potential when the measured average amount of discharged ink is less than the standard amount of discharged ink. This configuration can set an optimum bias potential, and as a result, variations of the degrees of discharge characteristics of ink droplets ejected from the nozzles corresponding to each region of the divided common electrode can be effectively reduced.

Other Embodiments

The embodiment of the present disclosure has been described above, but basic configuration of the present disclosure is not limited to the configuration described above. For example, while in first embodiment described above the weight of discharged ink droplets is measure and bias potential is accordingly set, the configuration is not limited to this example and bias potential may be set in accordance with the difference in density in a printing result obtained by printing a test pattern.

Moreover, while in the first embodiment described above the control device 200 includes the bias potential generating circuit 217 and the bias potential selection circuit 219 serving as the first bias output unit that outputs the first bias potential and the second bias output unit that outputs the second bias potential, the configuration is not limited to this example and the recording head 1 may include the bias potential generating circuit 217, the bias potential selection circuit 219, or both.

Furthermore, while in the first embodiment described above the configuration in which the recording head 1 includes a single array of the nozzle array 22 is used as an example, but the configuration is not limited to this example and the recording head 1 may include two or more arrays of the nozzle array 22. The two or more arrays of the nozzle array 22 may be aligned in the second direction Y or the first direction X in the recording head 1. In both cases, it only needs to divide the common electrode into at least two regions in each nozzle array 22 in a direction in which the nozzles 21 are aligned.

Further, while in the method for setting bias potential according to the first embodiment illustrated in FIG. 12 the average amount of discharged ink droplets ejected from each nozzle group corresponding to each of the regions is measured when a standard bias potential is supplied to all regions of the common electrode, the configuration is not limited to this example and the average amount of discharged ink droplets may be measured with respect to each region of the common electrode.

Further, the present disclosure is intended to be applied to any liquid ejecting head in general and may be applied to, for example, a recording head that is used for an image recording apparatus exemplified by a printer, such as various types of ink jet recording heads, a color material ejecting head that is used for fabricating color filters exemplified by liquid crystal displays, an electrode material ejecting head that is used for producing electrodes for organic EL displays, field-emission displays (FED), or the like, or a biological organic material ejecting head that is used for fabricating biochips.

In addition, while the ink jet recording apparatus I is used in the description as an example of the liquid ejecting apparatus, the present disclosure may be applied to any liquid ejecting apparatus using the other kinds of liquid ejecting heads described above.

What is claimed is:

1. A liquid ejecting head comprising:

a nozzle array composed of nozzles that are aligned and configured to discharge liquid;

pressure generating chambers communicating with the nozzles of the nozzle array; and actuators that are positioned to correspond individually to the pressure generating chambers, wherein each of the actuators includes a piezoelectric layer being sandwiched by a first electrode and a second electrode, the first electrode serves as individual electrodes provided individually for the respective actuators, and the second electrode is a divided electrode having a first portion that serves as a first common electrode that extends over the actuators corresponding to a first region of the nozzle array and a second portion that serves as a second common electrode that extends over the actuators corresponding to a second region of the nozzle array.

2. The liquid ejecting head according to claim 1, wherein the first common electrode and the second common electrode are coupled separately to individual input terminals.

3. The liquid ejecting head according to claim 1, wherein the second electrode serves as the first common electrode, the second common electrode and a third common electrode that extends over the actuators corresponding to a third region of the nozzle array, and the first region includes an end of the nozzle array, the second region includes the other end of the nozzle array and the third region includes the center of the nozzle array.

4. The liquid ejecting head according to claim 1, further comprising a common liquid chamber that communicates with the pressure generating chambers.

5. The liquid ejecting head according to claim 1, wherein the common electrode covers a partition wall between the pressure generating chambers.

6. A liquid ejecting apparatus, comprising:

the liquid ejecting head according to claim 1; and a controller that supplies a drive signal selectively to the individual electrodes of the actuator and that supplies a bias potential to the common electrode.

7. The liquid ejecting apparatus according to claim 6, wherein the controller supplies a first bias potential to the first common electrode and a second bias potential to the second common electrode, the second bias potential being different from the second bias potential.

8. The liquid ejecting apparatus according to claim 7, wherein a difference between an average amount of discharged liquid ejected from a first nozzle group constituted by the nozzles in the first region, and an average amount of discharged liquid ejected from a second nozzle group constituted by the nozzles in the second region is smaller than a difference between an average amount of discharged liquid ejected from the first nozzle group and an average amount of discharged liquid ejected from the second nozzle group when an identical bias potential is supplied to both the first common electrode and the second common electrode.

9. The liquid ejecting apparatus according to claim 7, wherein, the first bias potential is lower than the second bias potential on the assumption that:

when an identical bias potential is supplied to both the first common electrode and the second common electrode, an average amount of discharged liquid ejected from a first nozzle group constituted by the nozzles in the first region is more than an average amount of discharged liquid ejected from a second nozzle group constituted by the nozzles in the second region.

10. The liquid ejecting apparatus according to claim 6, wherein the controller supplies a first bias potential to the first common electrode and a second bias potential to the second common electrode, and the controller is configured to set independently the first bias potential and the second bias potential.

11. A liquid ejecting apparatus comprising:

a liquid ejecting head, comprised of:

a nozzle array composed of nozzles that are aligned and configured to discharge liquid;

pressure generating chambers communicating with the nozzles of the nozzle array; and actuators that are positioned to correspond individually to the pressure generating chambers, wherein each of the actuators includes a piezoelectric layer being sandwiched by a first electrode and a second electrode, the first electrode serves as individual electrodes provided individually for the respective actuators, and the second electrode serves as a first common electrode that extends over the actuators corresponding to a first region of the nozzle array and a second common electrode that extends over the actuators corresponding to a second region of the nozzle array; and a controller that supplies a drive signal selectively to the individual electrodes of the actuator and that supplies a bias potential to the common electrode, wherein the controller supplies a first bias potential to the first common electrode and a second bias potential to the second common electrode, the second bias potential being different from the second bias potential, wherein a difference between an average amount of discharged liquid ejected from a first nozzle group constituted by the nozzles in the first region, and an average amount of discharged liquid ejected from a second nozzle group constituted by the nozzles in the second region is smaller than a difference between an average amount of discharged liquid ejected from the first nozzle group and an average amount of discharged liquid ejected from the second nozzle group when an identical bias potential is supplied to both the first common electrode and the second common electrode.

12. A liquid ejecting apparatus comprising:

a liquid ejecting head, comprised of:

a nozzle array composed of nozzles that are aligned and configured to discharge liquid;

pressure generating chambers communicating with the nozzles of the nozzle array; and actuators that are positioned to correspond individually to the pressure generating chambers, wherein each of the actuators includes a piezoelectric layer being sandwiched by a first electrode and a second electrode, the first electrode serves as individual electrodes provided individually for the respective actuators, and the second electrode serves as a first common electrode that extends over the actuators corresponding to a first region of the nozzle array and a second common electrode that extends over the actuators corresponding to a second region of the nozzle array; and a controller that supplies a drive signal selectively to the individual electrodes of the actuator and that supplies a bias potential to the common electrode, wherein the controller supplies a first bias potential to the first common electrode and a second bias potential to the second common electrode, the second bias potential being different from the second bias potential, wherein the first bias potential is lower than the second bias potential on the assumption that:

when an identical bias potential is supplied to both the first common electrode and the second common electrode, an average amount of discharged liquid ejected from a first nozzle group constituted by the nozzles in the first region is more than an average amount of discharged liquid ejected from a second nozzle group constituted by the nozzles in the second region.

* * * * *